US005320154A

United States Patent [19]

Colson et al.

[11] Patent Number: 5,320,154

[45] Date of Patent: Jun. 14, 1994

[54] METHOD AND APPARATUS FOR MOUNTING A RETRACTABLE WINDOW COVERING

[75] Inventors: Wendell B. Colson, Boulder; Terry Akins, Louisville, both of Colo.

[73] Assignee: Hunter Douglas Inc., Upper Saddle River, N.J.

[21] Appl. No.: 717,284

[22] Filed: Jun. 20, 1991

Related U.S. Application Data

[63] Continuation-in-part of Ser. No. 626,916, Dec. 13, 1990, abandoned.

[51] Int. Cl.[5] ..... E06B 9/08

[52] U.S. Cl. ..... 160/121.1; 160/23.1; 160/291; 160/300; 160/303; 160/349.1; 160/392; 160/395

[58] Field of Search ..... 160/121.1, 23.1, 133, 160/291, 300, 303, 392, 395, 349.1

[56] References Cited

U.S. PATENT DOCUMENTS

| | | | |
|---|---|---|---|
| Re. 30,254 | 4/1980 | Rasmussen . | |
| 286,027 | 10/1883 | Lobdell | 160/392 |
| 1,937,342 | 11/1933 | Higbie . | |
| 1,958,695 | 5/1934 | Claus | 160/23.1 |
| 2,029,675 | 2/1936 | Schlamp . | |
| 2,110,145 | 3/1938 | Loehr . | |
| 2,140,049 | 12/1938 | Grauel | 160/121.1 |
| 2,267,869 | 12/1941 | Loehr . | |
| 2,834,412 | 5/1958 | Velke | 160/395 |
| 2,865,446 | 12/1958 | Cole . | |
| 2,914,122 | 11/1959 | Pinto . | |
| 3,292,685 | 12/1966 | Clark . | |
| 3,371,702 | 3/1968 | Keegan et al. | 160/395 X |
| 3,384,519 | 5/1968 | Froget . | |
| 3,421,276 | 1/1969 | LaBarge | 160/395 X |
| 3,661,665 | 5/1972 | Froget . | |
| 3,701,376 | 10/1972 | Froget . | |
| 3,783,931 | 1/1974 | Assael | 160/395 X |
| 4,019,554 | 4/1977 | Rasmussen . | |
| 4,039,019 | 8/1977 | Hopper . | |
| 4,182,088 | 1/1980 | Ball | 160/395 X |
| 4,194,550 | 3/1980 | Hopper . | |
| 4,344,474 | 8/1982 | Berman | 160/121.1 |
| 4,386,454 | 6/1983 | Chodosh . | |
| 4,519,434 | 5/1985 | Forquer | 160/133 |
| 4,694,543 | 9/1987 | Conley | 160/395 X |
| 4,799,299 | 1/1989 | Campbell | 160/395 X |
| 4,912,900 | 4/1990 | Yeamans | 160/395 X |
| 5,117,893 | 6/1992 | Morrison et al. | 160/291 |

FOREIGN PATENT DOCUMENTS

| | | | |
|---|---|---|---|
| 249985 | 1/1961 | Australia . | |
| 29442 | 11/1972 | European Pat. Off. . | |
| 0430882 | 6/1991 | European Pat. Off. | E06B 9/82 |
| 382758 | 11/1923 | Fed. Rep. of Germany . | |
| 684202 | 10/1939 | Fed. Rep. of Germany . | |
| 122088 | 4/1900 | Fed. Rep. of Germany . | |
| 1241361 | 9/1967 | Fed. Rep. of Germany . | |
| 7008554 | 7/1970 | Fed. Rep. of Germany . | |

(List continued on next page.)

*Primary Examiner*—David A. Scherbel
*Assistant Examiner*—Derek J. Berger

[57] ABSTRACT

Disclosed are methods and an apparatus for mounting and deployment of retractable covering devices, in particular, light control window covering including a lobed head rail to prevent creasing and/or skewing of the window covering when rolled up, the head rail having means for attaching the window covering which insures proper alignment of the window covering. Also included are a bottom rear rail having an antiskewing device which comprises a slidable weight for compensating for skewed roll up; a flip-catch device for preventing wrong-way roll up of the window covering; and a top-catch mechanism for preventing both wrong-way roll up and over rotation in the proper roll up direction.

56 Claims, 12 Drawing Sheets

U.S. PATENT DOCUMENTS

| | | |
|---|---|---|
| 1942674 | 10/1971 | Fed. Rep. of Germany . |
| 2304809 | 8/1974 | Fed. Rep. of Germany . |
| 2735654 | 4/1978 | Fed. Rep. of Germany . |
| 2923233 | 3/1980 | Fed. Rep. of Germany . |
| 2936811 | 12/1981 | Fed. Rep. of Germany . |
| 3525515 | 1/1987 | Fed. Rep. of Germany . |
| 8810922 | 12/1988 | Fed. Rep. of Germany . |
| 8906284 | 9/1989 | Fed. Rep. of Germany . |
| 319458 | 3/1902 | France . |
| 847779 | 10/1939 | France . |
| 1166398 | 4/1957 | France . |
| 1309194 | 1/1961 | France . |
| 1321456 | 2/1963 | France . |
| 1364674 | 9/1963 | France . |
| 1373515 | 7/1964 | France . |
| 1480262 | 7/1966 | France . |
| 1465261 | 9/1966 | France . |
| 1381472 | 12/1966 | France . |
| 1526507 | 6/1967 | France . |
| 1585159 | 1/1968 | France . |
| 2217518 | 9/1974 | France . |
| 2398170 | 12/1979 | France . |
| 7805464 | 8/1978 | Netherlands . |
| WO8002712 | 9/1971 | PCT Int'l Appl. . |
| 331432 | 7/1958 | Switzerland . |
| 423207 | 4/1967 | Switzerland . |
| 476482 | 11/1969 | Switzerland . |
| 494338 | 4/1970 | Switzerland . |
| 979683 | 1/1965 | United Kingdom . |
| 1228677 | 11/1971 | United Kingdom . |

METHOD AND APPARATUS FOR MOUNTING A RETRACTABLE WINDOW COVERING

CROSS-REFERENCE TO RELATED APPLICATION

This application is a continuation-in-part of application Ser. No. 07/626,916, filed Dec. 13, 1990, now abandoned.

BACKGROUND OF THE INVENTION

The present invention relates to apparatus and methods for mounting retractable covering devices useful for covering various architectural openings and as retractable space dividers. Most particularly, the present invention relates to roller type deployment and mounting of light control window coverings having first and second parallel sheets and a plurality of transverse vanes connecting said sheets.

Fabric light control window coverings are known in the art, an illustrative disclosure is U.S. Pat. No. 3,384,519 to Froget. Froget discloses a shade having two parallel mesh fabric sheets with a number of movable vanes disposed between the sheets. The parallel fabric sheets are movable relative to each other in order to control the angle of the blades. This shade is attached to a typical cylindrical roller shade head roller for rolling up the shade and controlling the angle of the blades. Similar disclosures are found in U.S. Pat. Nos. 2,029,675 and 2,140,049 and French patent No. 1,309,194. German patent No. 382,758 discloses a similar window covering, however instead of a cylindrical head roller an elliptical head roller is provided.

As illustrated in the above disclosures, such a window covering is generally a sandwich of three layers which are attached together at various points. As the sandwich rolls around a roller, the layer around the outside must travel a greater distance than the inner layer. The thicker the sandwich is, and particularly the blades, the more pronounced this effect becomes. Thus, in practice with known deployment means, as the window covering rolls up around the head roller, the outer layer must stretch or the inner layer must buckle in order to accommodate the different distances that the two layers follow around the roller. Stretchy fabrics are undesirable because the blades would be unaligned in the lowered position and if non-stretchy fabrics are used the inner layer must form buckles 100 as illustrated in FIG. 6. However, buckles 100 can cause a permanent wrinkle or crease to develop in the fabric over time. This is because as the window covering 102 is wrapped tightly around the roller 104 there is a constant pressure compressing the buckle 100 in the inner layer between the other layers and against the roller itself. In addition to an unattractive appearance, the buckles also create a high point on the roller which can occur unevenly and cause the window covering to roll up unevenly or skew to one side of the roller.

U.S. Pat. No. 4,344,474 to Berman discloses an insulated shade which includes a number of layers wrapped around a cylindrical head roller. While not a light control shade, the layers of the Berman shade appear to be connected together by bushings. Berman has recognized that the different layers will roll up at different rates and has provided journal plates having slotted holes to retain the bushings. This allows relative sliding between the bushings in an attempt to compensate for the different roll up rates of the different layers.

In roller shades in general it is important that the fabric be fastened to the head roller at an exact right angle to the cut edges of the fabric. This is to insure that the fabric rolls up straight along the head roller without skewing to the left or right. The curtain roller disclosed in U.S. Pat. No. 286,027 to Lobdell is an attempt to solve this problem in typical single sheet roller shades. Two slats are provided, one having tacks extending outward therefrom. The slot with tacks is positioned at the top of the curtain, at a right angle to the longitudinal line of direction of the curtain. The tacks are pressed through the curtain fabric and the second slat is pressed on to the tacks on the opposite side of the curtain. The slats attached to the curtain are slid into a complimentary groove in the roller. This construction has disadvantages in not being self aligning and requiring that the slats be placed very exactly on the curtain fabric.

A further drawback of known deployment systems for this type of window covering is that they may be rolled up the wrong way. This would result in the blades being folded back over themselves at the point of attachment to the fabric sides giving rise to at least two difficulties. First, the bulk of the window covering when rolled up would be increased. Second, if the blades were initially made without creases at the attachment points, creases would be formed due to the folding over.

SUMMARY OF THE INVENTION

It is therefore an object of the present invention to provide a means for rolling and unrolling a layered light control covering device which does not create permanent creases or wrinkles in the layers and also allows for rolling without skewing of the covering device to the left or right. In achieving this object, the present invention employs a roller having a discontinuous surface formed by outwardly extending lobes or rounded projections which define recesses to receive buckles formed in the inner layer of the covering device as it is rolled on to the roller. Thus, the buckles are not pressed against the roller to form permanent creases or wrinkles. Also the buckles do not create high spots which would cause the covering device to skew to the left or right when rolled onto the roller. In this regard, a further feature of the present invention is a bottom rail with a slidable weight which may be selectively transversely positioned to compensate for inconsistencies in manufacture and mounting which lead to skewing.

Another object of the present invention is to provide a simple means of attachment for such a covering device to a head roller, which means ensures alignment of the covering device with the head roller. To achieve this object the present invention provides a recess in the roller parallel to the roller axis. The line of attachment between the top vane and one sheer fabric is received in the recess and held in place by a holding means. Because all vanes are parallel to one another, they are then parallel to the roller.

In one embodiment, the holding means includes a triangular channel in the head roller which receives a wedge shaped filler strip. The recess just described is formed by the vertex of the triangular channel. The wedge shape of the filler strip cooperates with one of the sheer fabrics and the top vane of the covering device to force the window covering along the line of attachment between the vane and fabric into the triangular channel, thus ensuring proper alignment. A second channel may be provided for attaching the opposite sheer fabric and is designed to tension the first vane against the wedge shaped filler strip, thus further insuring proper alignment. The second channel may be provided with a circular cross section formed in the roller means. The circular channel has an opening which is less in the inside diameter of the channel. The second sheer fabric is wrapped around a resilient tubular clamping member which is forced through the opening into the circular channel. In another embodiment, the second channel is V-shaped and the second sheer fabric is secured to a complementary V-strip and inserted in the V-shaped channel such that the second sheer fabric is firmly held between the V-shaped channel and the V-strip. In still another embodiment, the first and second sheer fabrics are attached to a roller means simultaneously by securing both the first and the second sheer fabrics to the same slat or strip and then force fitting this common slat or strip into a complementarily shaped roller means.

Additionally, an elongated member may be attached along the bottom of the covering device utilizing the triangular channel and a wedge shaped filler strip to provide a finished appearance to the shade. In a second embodiment, a bottom rail assembly having a C-shaped cross section is attached to the ends of the two sheer fabrics of the window covering to provide a different finished appearance to the shade.

A further object to the invention is to provide a method and apparatus for mounting such a covering device in a manner which prevents the covering being rolled up the wrong way. In this regard, the present invention employs a flip-catch mechanism which engages a stop member to prevent rotation of the covering device beyond a desired point when fully unrolled. A preferred embodiment includes a catch member pivotably connected to the roller means and moveable between a first position pivoted inwardly and rolled at least partially inside the fabric of the covering device and a second position pivoted outward and engaging the stop member which is fixed relative to the roller means.

Still another object of the present invention is to provide a method and apparatus for mounting a covering device in a manner which prevents wrong way roll up of the covering and prevents jamming of the rolling mechanism due to over rotation of the roller means in the proper roll up direction. In this regard, the present invention uses a novel top-catch mechanism which engages a portion of the roller means to prevent further rotation of the covering device beyond the point of being fully unrolled, and which engages a bottom rail assembly of the covering device to prevent further rotation of the roller means when the covering device is fully rolled up.

Yet another object of the invention is to provide a method and apparatus for mounting a covering device together with a valance, which does not require exact or precise measurement and placement of the mounting brackets being used to secure the covering device to a supporting surface.

These and other objects of the invention will be realized by the present invention which generally includes a roller means for rolling and unrolling the window covering without creating wrinkles or creases.

DESCRIPTION OF THE DRAWING

The features and advantages of the present invention will be more readily apparent from the following detailed description of the preferred embodiments, illustrated in the drawing figures wherein.

DETAILED DESCRIPTION OF THE PREFERRED EMBODIMENT

Figure 1:
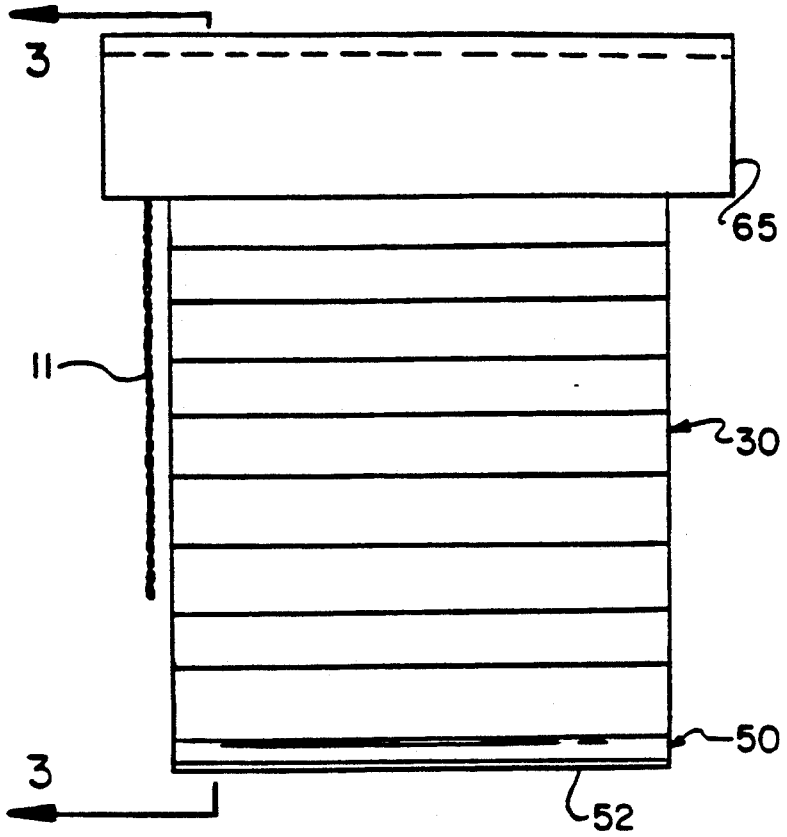
FIG. 1 is a front elevation view of a window covering according to the present invention.
Figure 2:
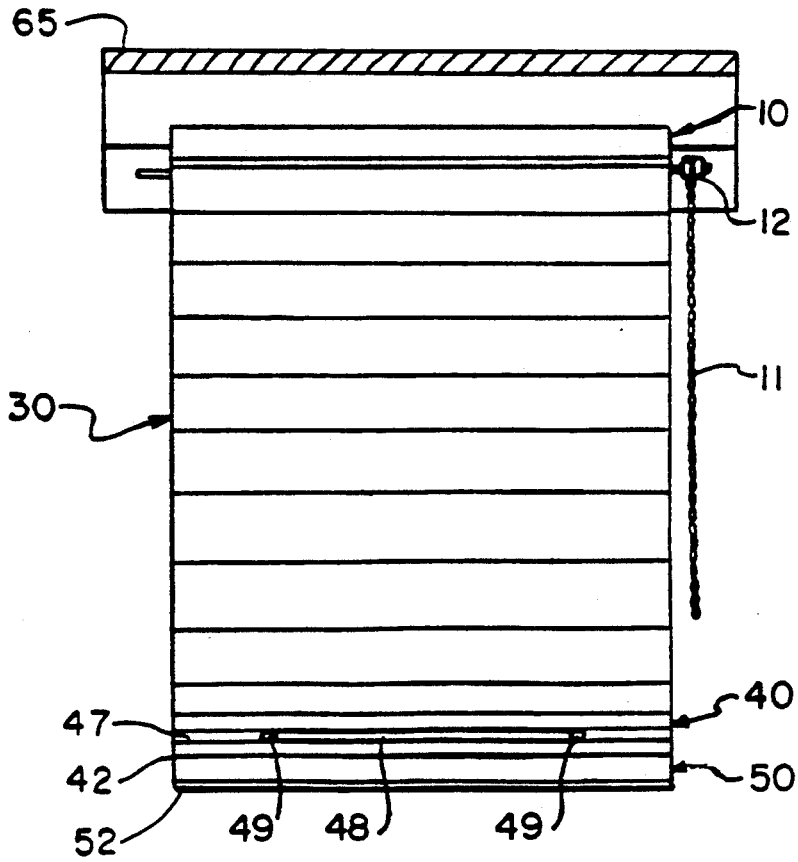
FIG. 2 is a rear elevation view of the window covering of FIG. 1.

While the description of the invention is made below with reference to window coverings, the teachings of the present invention are also applicable to devices for covering openings of all types and also for use as room dividers. Referring first to FIGS. 1 and 2, the main components of the present invention may be pointed out. These are head roller assembly 10, light control window covering 30, rear bottom rail assembly 40 and front bottom rail assembly 50. Also illustrated is valance 65 which cooperates with flip-catch mechanism 60, shown in FIG. 3. The head roller assembly 10 is rotatably mounted and driven in a known manner by a chain or cord 11 cooperating with wheel 12.

Figure 3:
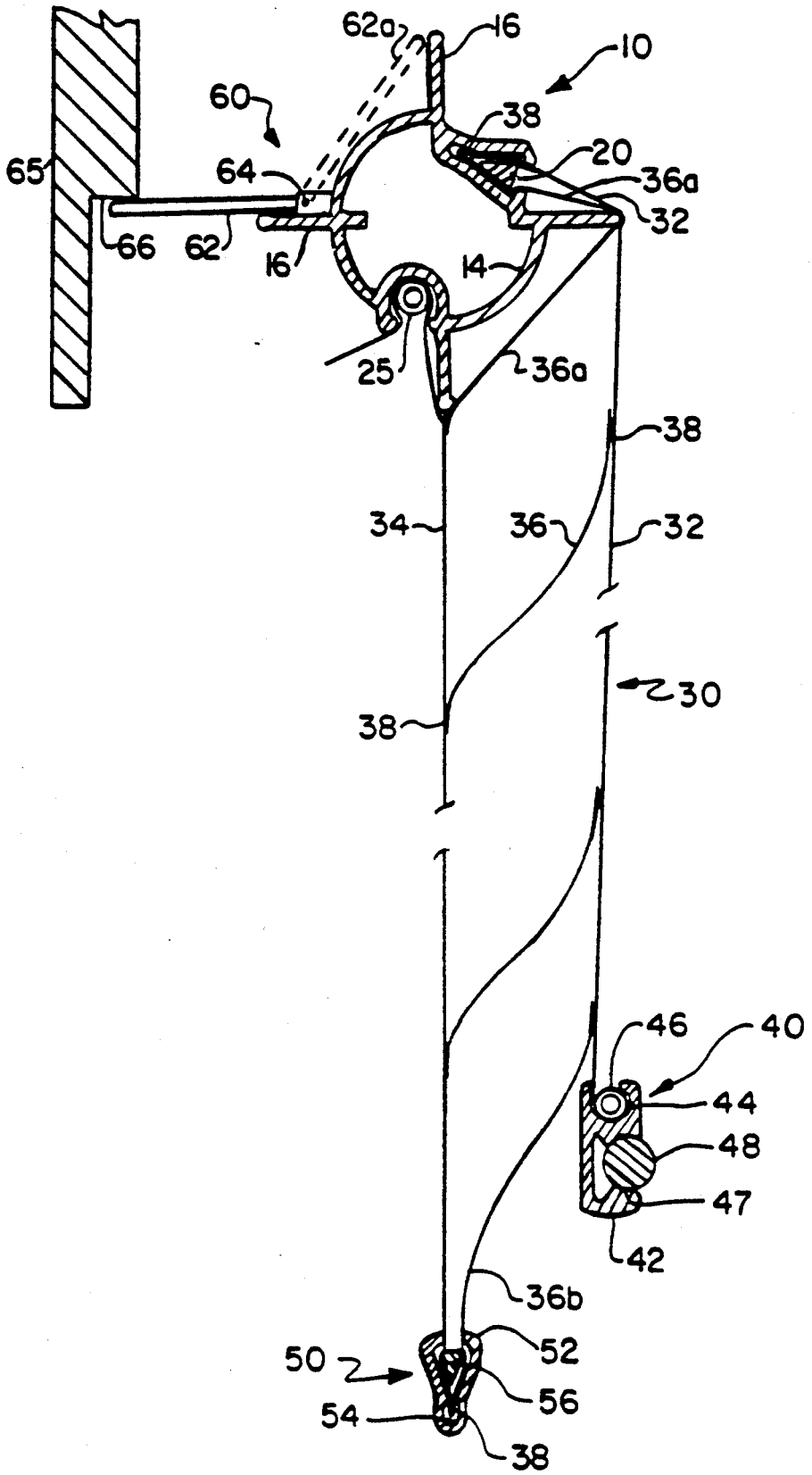
FIG. 3 is a cross-sectional view of the window covering of FIG. 1 as viewed through line 3—3 in FIG. 1.

As shown in FIG. 3, in a preferred embodiment of the present invention, the light control window covering 30 includes first and second parallel sheer fabrics 32 and 34 which are connected by a number of transverse fabric vanes 36 to form a light control element. Relative motion of first and second sheer fabrics 32 and 34 in a direction perpendicular to vanes 36 changes the angle of the vanes and thus controls the amount of light admitted through the window covering. Preferably, vanes 36 are adhesively bonded to the sheer fabrics in a manner which tends to bias first and second sheer fabrics 34 and 32 towards one another. Vanes 36 are also preferably applied with adhesive bond lines 38 exactly perpendicular to the longitudinal edges of the sheer fabrics 32, 34. It should be appreciated that the present invention relates to apparatus and methods for mounting and deploying such coverings. As such, the present invention may be used with coverings made with any flexible sheet material and flexible, strip material for the sides and vanes of the covering device. In this regard, reference to sheer fabrics and fabric vanes throughout should not be considered as limiting of the present invention.

Figure 5:
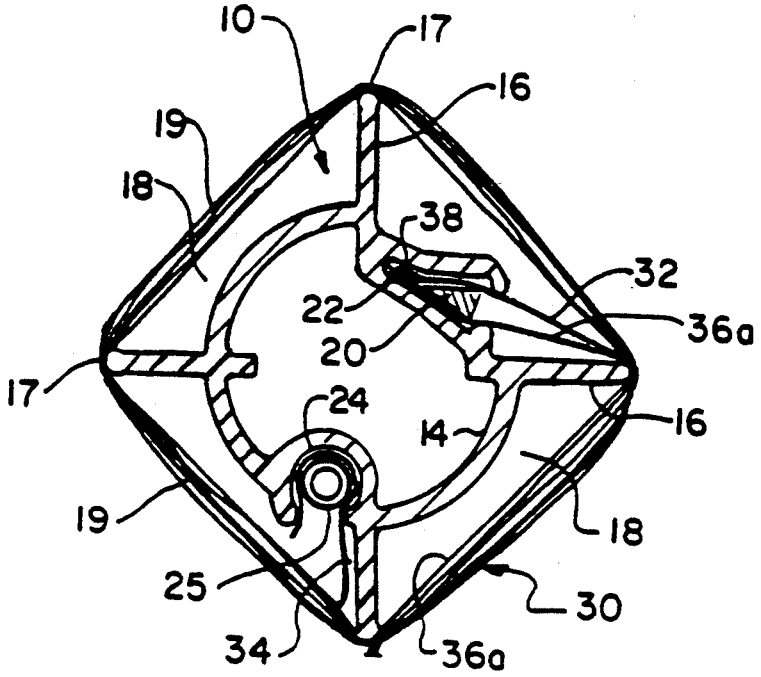
FIG. 5 is an enlarged cross-sectional view of the head roller according to the present invention illustrating the function of the lobed projections.
Figure 6:
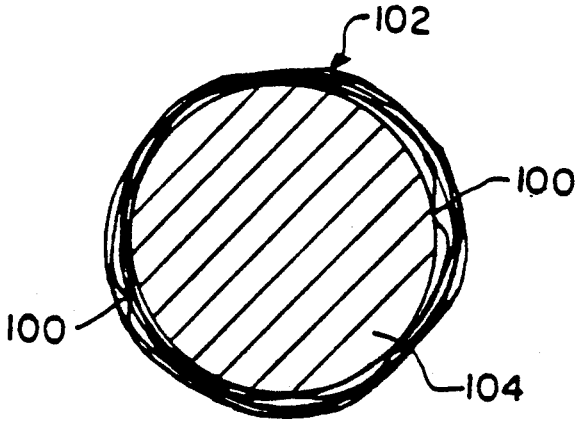
FIG. 6 PRIOR ART
FIG. 6 is a cross-sectional view of a head roller according to the prior art.

The head roller assembly 10 according to a preferred embodiment of the present invention is shown in greater detail in FIG. 5. A rigid central support member 14 is provided with a number of lobes or rounded projections 16. In the embodiment illustrated in FIG. 5 four lobes are utilized. Depending on the size of the head roller and the characteristics of the fabric, the number of lobes may be varied in order to provide the desired function as discussed below. In particular, three lobes have also been found to work satisfactorily.

Lobes 16 allow the fabric window covering to wrap around four linear bumps 17 extending transversely across the window covering 30. The window covering wraps tightly at bumps 17 and then follows a relatively straight line to the next linear bump 17. Lobes 16 provide a discontinuous surface with recesses 18 formed between lobes 16 The window covering is thus able to wrap loosely with relatively low pressure on the layers located in recesses 18 between the lobes 16. Buckles 19, which develop between the fabric layers of window covering 30 due to the layered construction, form in the loosely wrapped straight portions between lobes 16 and are not set into the window covering by pressure against the head roller because they fall within recesses 18 Also, because the buckles 19 occur in recesses 18 and are not pressed against the roller as in the prior art, window covering 30 wraps tightly around lobes 16 and rolls up straight without skewing.

Although lobes 16 which project radially outwardly from the support member 14 are illustrated in FIG. 5, the linear bumps 17 can be provided directly on the surface of the support member. For example, the support member can be rectangular, with the four corners of the rectangular support member defining the linear bumps. The number of linear bumps is not limited to four, and support members of any regular or irregular polygonal cross section can be used provided that there is a relatively straight line path of sufficient length between adjacent linear bumps to provide an area in which the window covering is loosely wrapped and not compressed. As a practical matter, suitable polygonal support members are those having at least 3 and preferably no more than 6 sides. Support members having a modified polygonal cross section are also suitable for use in this invention. One type of preferred modified polygonal support member is one in which the sides extending between the linear bumps are curved inwardly, rather than straight, in order to provide deeper recesses for receiving the buckles formed in the loosely wrapped straight portions between the linear bumps. The support member can also have only two linear bumps or contact points for the window covering. Examples of such a structure include a substantially flat support member wherein the longitudinal edges of the support member define the linear bumps, or two spaced apart cylindrical rods of small diameter, wherein each cylindrical rod defines a linear bump and the spaces between the two cylindrical rods provides the recesses for the buckles.

As can be appreciated from the above description, numerous configurations of a support member for a head roller assembly are possible within the scope of the invention. The roller includes a plurality of means for defining apexes on an outer surface thereof. The apex defining means provide longitudinal contact points for the window covering around the roller and the apex defining means are spaced apart so as to provide a substantially straight path for the window covering from one apex defining means to an adjacent apex defining means. The important features of the support member are that it includes at least two linear bumps at which the window covering wraps tightly and then follows a relatively straight line between linear bumps to provide an area in which the window covering is not compressed. In order to prevent the buckles which form in the loosely wrapped straight portions between linear bumps from being set in the window covering, each straight line path between linear bumps should be at least one-half inch in length.

As previously discussed, it is important that the fabric of roller shades be fastened to the head roller at an exact right angle to the edges of the fabric. This is to ensure that the fabric will roll up straight along the head roller without skewing to the left or right. With fabric light control window coverings this factor is also present, however there is a second important factor. The second factor is that the position of mounting of the window covering to the head roller with respect to the individual vanes is important. If the window covering is not mounted with the correct alignment relative to the vanes, the window covering may not close all the way or may not operate correctly when fully deployed.

In the present invention the apparatus for and method of attachment of the window covering to the head roller ensures proper alignment of first and second sheer fabrics 32, 34 with respect to the head roller and also proper alignment of vanes 36 with respect to the head roller. The attachment means utilizes a wedge shaped filler strip 20 which inserts into a complementarily wedge shaped channel 22. The filler strip 20 is placed between sheer fabric 32 and top vane 36*a*. The wedge shape of the filler strip 20 centers itself against the adhesive line 38 which bonds sheer fabric 32 and top vane 36*a*. With filler strip 20 placed between sheer fabric 32 and vane 36*a*, the fabric and filler strip are inserted into channel 22 from one end of head roller assembly 10. Alternatively, the head roller may be designed to accept the filler strip by inserting it generally radially with a snap fit. As the fabric is inserted into channel 22 adhesive line 38 is forced by wedge shaped filler strip 20 into the vertex of channel 22. The vertex forms a recess parallel to the roller axis for receiving the adhesive line. This ensures the centering of the fabric construction in channel 22 along head roller central support 14 and attachment at a right angle to the head roller.

Figure 8:
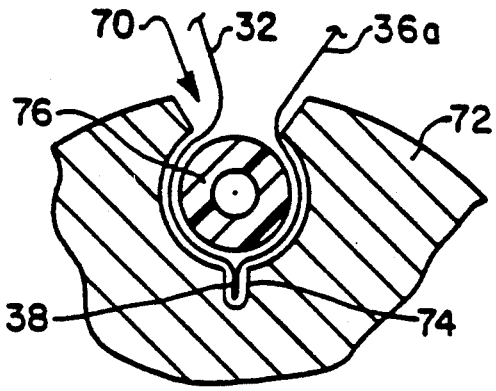
FIG. 8 is a partial cross-sectional view of an alternative attachment means according to the present invention.

In an alternative embodiment, shown in FIG. 8, a channel 70 is provided in head roller 72 with a longitudinal recess 74 parallel to the roller axis. Recess 74 is adapted to receive adhesive line 38. Insertion of filler strip 76 thus locates adhesive line 38 in longitudinal recess 76 along the length of head roller 72 to guarantee correct alignment of the window covering. Channel 70 and filler strip 76 need not be circular as shown in FIG. 8. Practically any cross-sectional shape will perform as desired if recess 74 is formed parallel to the roller axis and the channel and filler strip cooperate to prevent slippage of the fabric. Filler strip 76 may be resilient compressible material which is capable of insertion through the radially directed opening of channel 70, or it may be a less resilient material which is inserted into channel 70 through an opening at one end.

Second sheer fabric 34 is secured into a second, circular channel 24 by wrapping around a length of compressible tubing 25 sized to be pressed into channel 24. A 3/16 inch vinyl tubing with a complementarily sized channel has been found to adequately secure the fabric. The attachment of the second sheer fabric in this manner pulls vane material 36*a* tightly across lobes 16 and thus ensures that adhesive line 38 is centered on the wedge shaped filler strip 20 to guarantee perpendicular alignment of the window covering with the head roller.

Figure 9A:
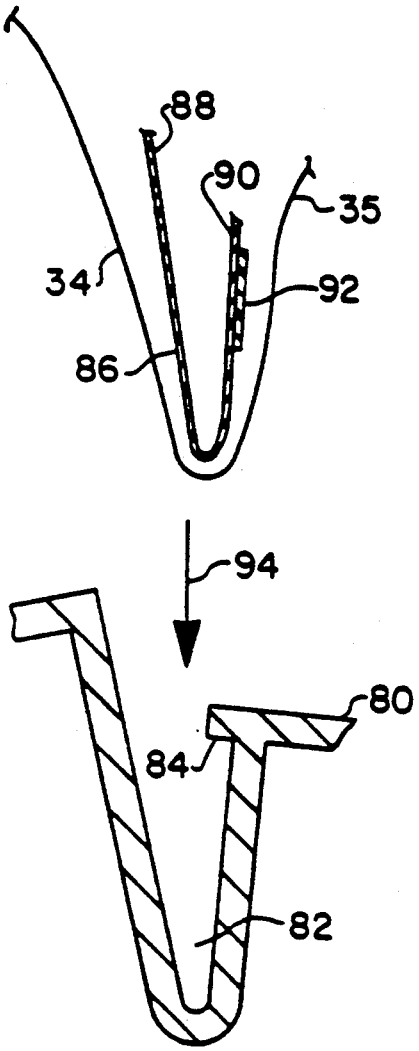
FIGS. 9*a–b* are partial cross-sectional views of a further alternative attachment means according to the present invention.
Figure 9B:
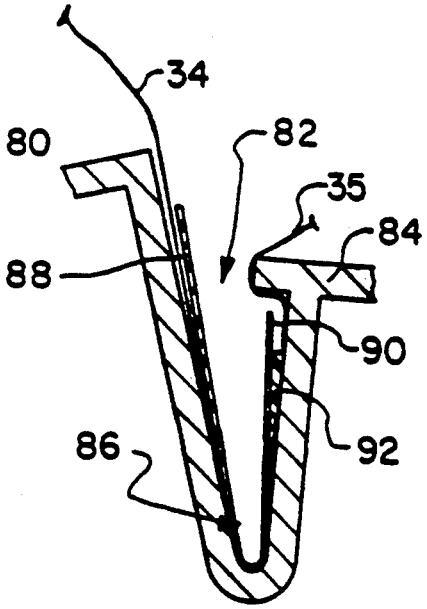

An alternative embodiment for the attachment of second sheer fabric 34 to the head roller is shown in FIGS. 9*a* and 9*b*. Head rail 80 is provided with V-shaped channel 82. One leg of V-shaped channel 82 has a inwardly projecting stop 84 and the opposite leg extends outward, beyond stop 84. V-strip 86 is provided having longer leg 88 and a shorter leg 90. Second sheer fabric 34 is passed around V-strip 86 with the cut off edge 35 of second sheer fabric 34 positioned adjacent to and extending slightly beyond shorter leg 90. Adhesive transfer tape 92 is provided at least on shorter leg 90 to grip, at least temporarily, the fabric. With second sheer fabric 34 wrapped around V-strip 86, the V-strip is inserted into V-shaped channel 82 as indicated by arrow 94. The V-strip cooperating with the V-shaped channel, combined with the adhesive transfer, helps to ensure that the second sheer fabric is attached perpendicular to the V-shaped channel. The biasing force of V-strip 86 in channel 82 also pulls first vane 36*a* tightly across the lobes as required.

V-strip 86 is preferably made of a resilient material to allow a snap fit into channel 82. It has been found that polycarbonate or a polyester such as 10 mil MYLAR provides sufficient stiffness to hold the fabric yet retains the resiliency necessary for a snap fit.

The various attachment means are illustrated in the drawing figures with component parts spaced apart in order to clearly illustrate each layer and part. In practice, the fabric layers are tightly pressed between the adjoining parts.

When the window covering 30 is fully unrolled from head roller assembly 10, the angle of vanes 36 may be controlled by rotation of the head roller assembly. In order to provide the window covering with a crisp and taut appearance and also ensure that the vanes 36 move correctly between open and closed positions, a weighted rear bottom rail assembly 40 is provided. The rear bottom rail assembly also provides an anti-skew device which is useful not only with fabric light control window coverings, but with any type of roller shade.

Even with the lobed headrail as discussed above, slight inconsistencies in manufacture, or mounting of the head roller slightly off of the horizontal line can cause the window covering to skew to the left or right when rolled up. The anti-skew device of the present invention provides a novel method and apparatus for compensating for such inconsistencies in manufacture or mounting. Rear bottom rail assembly 40 includes a rigid member 42 which may be provided with a circular channel 44 and compressible tubing 46 for attachment of sheer fabric 32 in the same manner as sheer fabric 34 is attached to head roller assembly 10. Preferably, however, attachment means such as shown in FIGS. 9*a* and 9*b*, including V-shaped channel 82 and V-strip 86, is utilized for the rear bottom rail assembly.

Rigid member 42 is also provided with channel 47 which slidingly receives weight 48. The position of weight 48 along channel 47 may be fixed by retainer clips 49 (shown in FIG. 2) which may be squeezed to slide in channel 47 and released to grip the channel. If, for example, the window covering was skewing to the right as it was rolled up, this could be corrected by sliding weight 48 to the right. This creates a greater tension on the right hand side of the window covering, causing the window covering to be rolled tighter around the head rail on that side and thus have a smaller diameter which will cause the shade to begin to skew to the left. Weight 48 may be moved back and forth until the window covering rolls up straight without left or right skewing.

Front bottom rail assembly 50 is essentially a decorative finish for the bottom front of the window covering. Rigid member 52 is provided with a channel 54 which receives wedge shaped filler strip 56. Wedge filler strip 56 is placed between vane 36*b* and second fabric 34 to secure bottom rail assembly 50 to the window covering in the same manner as first fabric 32 and vane 36*a* are secured to the head roller. Wedge shaped filler strip 56 ensures that the front bottom rail assembly 50 is parallel to vanes 36 and perpendicular to the first and second sheer fabric edges. Alternatively, the embodiment shown in FIG. 8 may be utilized. In a further alternative embodiment, the front and rear bottom rails may be combined into a single bottom rail.

Figure 10:
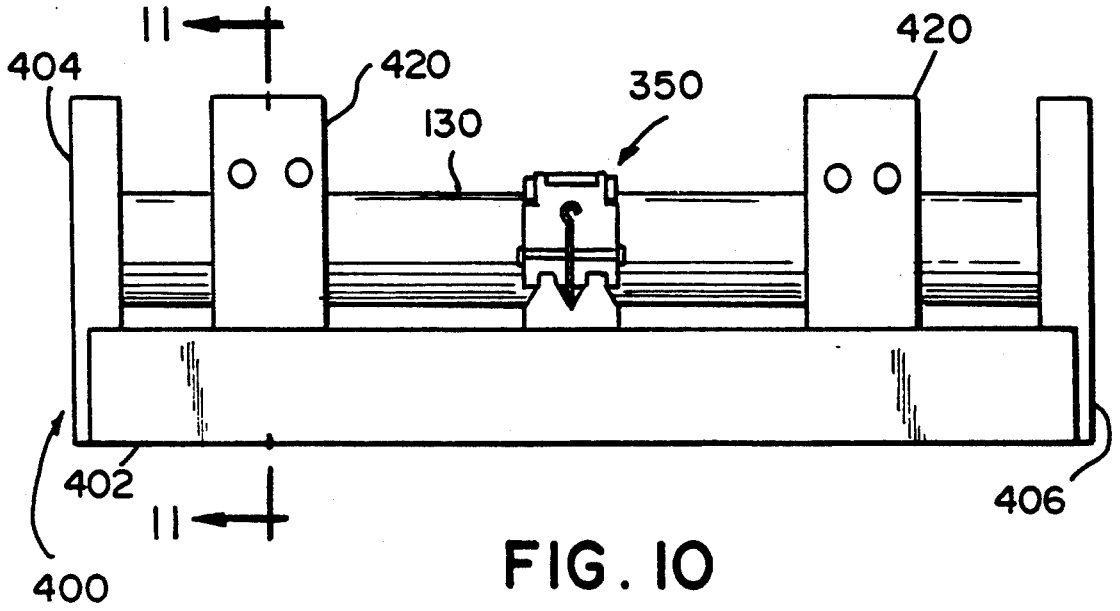
FIG. 10 is a top view of another embodiment of a window covering of the present invention, including means for mounting the window covering on a wall or ceiling.
Figure 11:
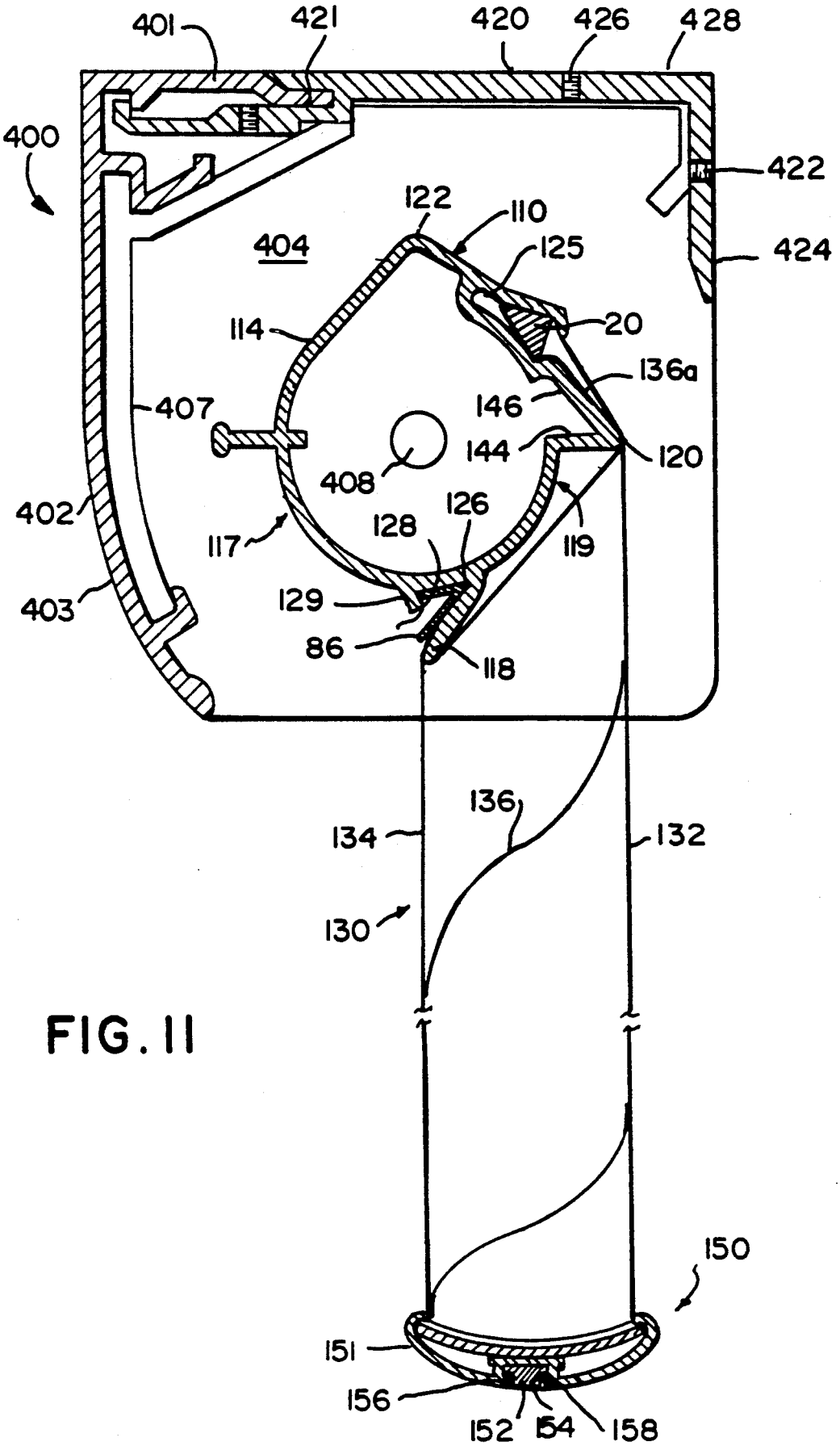
FIG. 11 is a cross-sectional view of the window covering of FIG. 10, taken along line 11—11 of FIG. 10.

Another preferred embodiment of the present invention, including a valance 400, mounting brackets 420, top-catch mechanism 320, head roller assembly 110, window covering 130 and bottom rail assembly 150, is shown in FIGS. 10 and 11. FIG. 10 is a top view showing valance 400, mounting brackets 420 and the top-catch mechanism 350 of the present invention. The valance 400 may be fabricated as a single, unitary structure; however, in the embodiment shown FIGS. 10 and 11, the valance 400 comprises three separate parts: a front rail 402 and two opposed end caps 404, 406. Front rail 402 and end caps 404, 406 are provided with complementary ribs and grooves to enable end caps 404, 406 to be removably snap fit onto the opposed ends of front rail 402. Referring now to FIG. 11, the rib 407 of end cap 404 is received in groove 403 of front rail 402 to join the front rail 402 to end cap 404. As seen in FIG. 11, the end cap 404 has a cylindrical projection 408 provided on the inner surface thereof for mounting the head roller assembly 110 of window covering 130 in the valance 400. Similarly, end cap 406 is provided with a cylindrical projection (not shown) for rotatably mounting the head roller assembly 110 of the window covering 130 in the valance 400.

Two mounting brackets 420 are provided to mount the valance 400 against a wall or against a ceiling to cover a window. Each mounting bracket 420 is provided with a groove 422, for securely receiving the upper edge 401 of the front rail 402 of the valance 400, as shown in FIG. 11. Each mounting bracket 420 can be provided with additional features, such as ribs, grooves and the like which are complementary to the rib and groove structure of the inner surface of the front rail 402, to provide additional points of engagement and support between the mounting brackets 420 and the valance 400.

An important advantage of using mounting brackets 420 is that the mounting brackets 420 need not be precisely located on the wall or ceiling so as to support the very ends of the valance 400 or the head roller assembly 110. In contrast to conventional mounting means for roller type window coverings, there is considerable latitude for the relative placement of mounting brackets 420 on a wall or ceiling. Provided that the mounting brackets 420 are spaced apart sufficiently to adequately support the valance 400 in proper alignment, the exact spacing between mounting brackets 420 on a wall or ceiling is not critical. Mounting brackets 420 are conveniently secured to a wall by a screws, molly bolts or the like inserted into a wall through hole 422 in the downwardly extending leg 424 of the mounting bracket 420 or into a ceiling through holes 424 in the upper leg 428 of the mounting bracket 420.

The other main components of this embodiment are head roller assembly 110, light control window covering 130 and bottom rail assembly 150, which are shown in detail in FIG. 11. Head roller assembly 110 includes a rigid central support member 114 provided with a number of lobes or rounded projections 116, 118, 120 and 122. Recess 117 is formed between lobes 116 and 118, and recess 119 is formed between lobes 118 and 120. In the embodiment of FIG. 11, in contrast to the embodiment of FIG. 5, each of the lobes or rounded projections 116, 118, 120 and 122 has a different structural configuration. Lobe 116 is similar in structure to lobe 16 of the head roller assembly 10 of FIG. 5. Lobe 118 extends outwardly from the longitudinal axis of the rigid support member 114. However, lobe 118 is an angled projection and does not extend radially outwardly from support member 114 as does lobe 116.

Lobe or rounded projection 118 also forms one leg of a V-shaped channel 126. The opposite, shorter leg 128 of V-shaped channel 126 is formed along the outer surface of support member 114. The shorter leg 128 of the V-shaped channel 126 terminates in stop 129, which projects outwardly from the surface of the support member 114 and inwardly into V-shaped channel 126. The V-shaped channel 126 of the head roller assembly 110 cooperates with the V-strip 86 shown in FIG. 9*a* to secure the second sheer fabric 134 to the head roller assembly 110, in the manner described above with reference to FIGS. 9*a* and 9*b*.

Head roller assembly 110 also includes a wedge shaped channel 125, similar in configuration to wedge shaped channel 22 of the head roller assembly 10 shown in FIG. 5. The wedge shaped channel 125 is configured to be complementary to the wedge shaped filler strip 20, shown in FIG. 5. As discussed with reference to FIG. 5, the wedge shaped filler strip 20 in combination with the wedge shaped channel 125 of the head roller assembly 110 provides attachment means for securing the window covering 130 to the head roller assembly 110 and ensuring proper alignment of the first and second sheer fabrics 132, 134 and the vanes 136 with respect to the head roller.

Lobe 120 is provided along support member 114, adjacent the end of the wedge shaped channel 125 formed along the outer surface of the support member 114. Lobe 120 extends outwardly from the longitudinal axis of the support member 114. However, instead of a straight radially outwardly extending projection like lobe 116, lobe 120 is formed by two legs 144, 146. Leg 144 of lobe 120 extends substantially radially outwardly with respect to the longitudinal axis of the support member 114. Leg 146 of the lobe 120 slopes downwardly from the distal end of leg 144 to a location along the support member 114 adjacent the end of the wedge shaped channel 125. When the window covering 130 is secured to the head roller assembly 110 using a wedge shaped filler strip 20 inserted in wedge shaped channel 125, the top vane 136*a* is supported against the sloping leg 146 of the lobe 120.

In the embodiment shown in FIG. 11, lobe 122 extends radially outwardly from the longitudinal axis of the support member 114, and is formed by an eccentric portion of the support member 114, rather than a separate outward projection from the circumferential surface of the support member 114 like projections or lobes 116, 118 and 120. It is not required that the lobe 122 have this particular shape. Lobe 122 may extend radically outwardly a distance less than lobes 116, 118 and/or 120, as shown in FIG. 11; however, this difference in radical extension is not essential. Similarly, in other embodiments of the head roller assembly of the invention, the distances which the lobes or projections extend from the support member, relative to one another, are not critical.

In the embodiment shown in FIG. 11, the front and rear bottom rails are combined into a single bottom rail assembly 150. The bottom rail assembly 150 includes a single, extruded bottom rail structure 151, preferably of extruded aluminum, having a substantially C-shaped cross section. A longitudinally extending weight receiving channel 152 is provided in the bottom of bottom rail 151. A weight 154 is slidably received in the weight receiving channel 152 and is retained therein by retaining lips 156, 158 of the bottom rail 151. The position of weight 154 within weight receiving channel 152 can be adjusted as necessary to counteract any skewing of the window covering 130 as it rolls up around the head roller, as described with respect to the embodiment shown in FIG. 3.

Figure 12A:
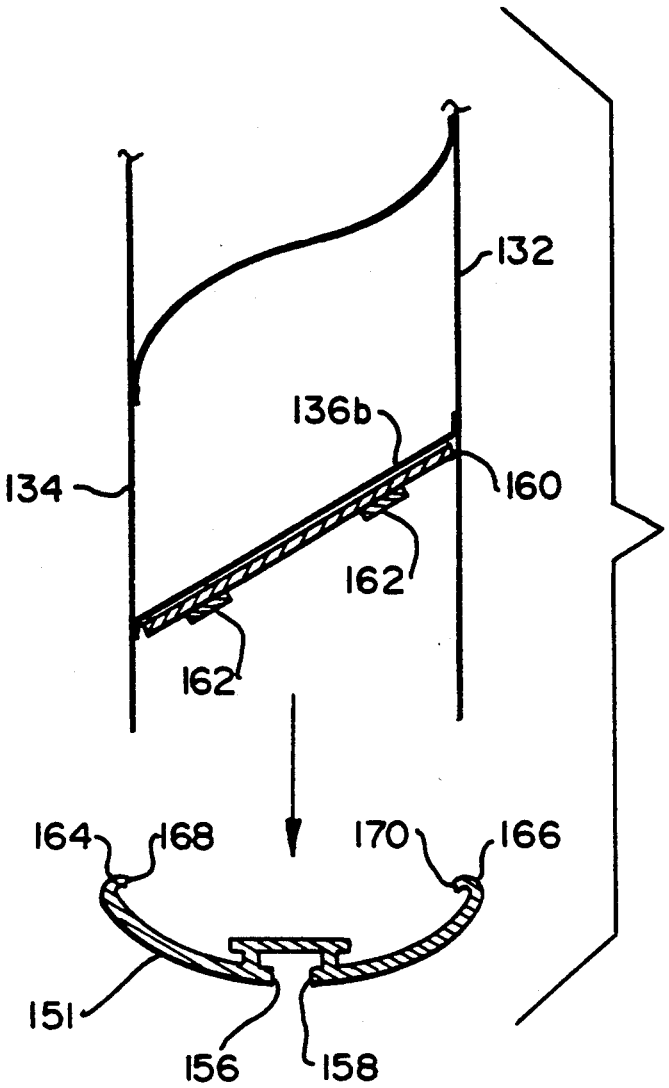
FIGS. 12*a*, 12*b* and 12*c* are partial cross-sectional views of an alternative bottom rail assembly according to the present invention.
Figure 12B:
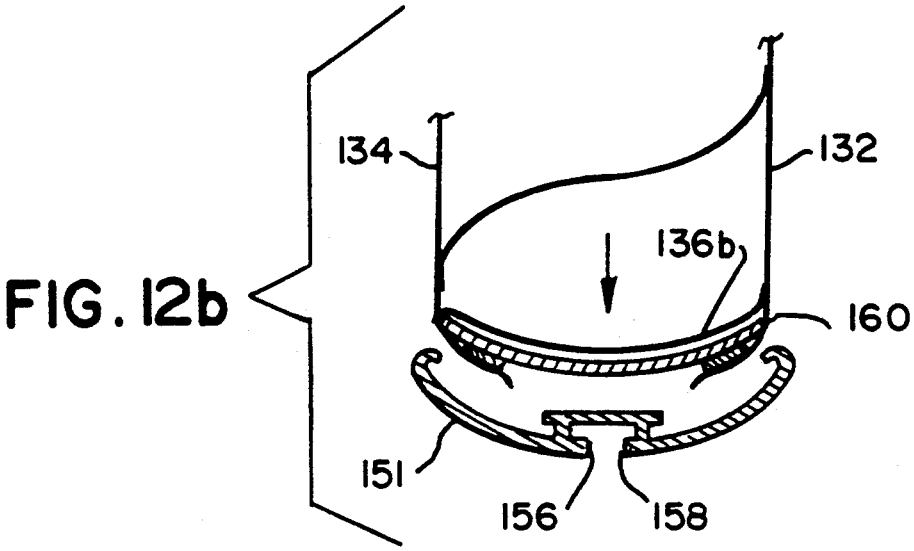
Figure 12C:
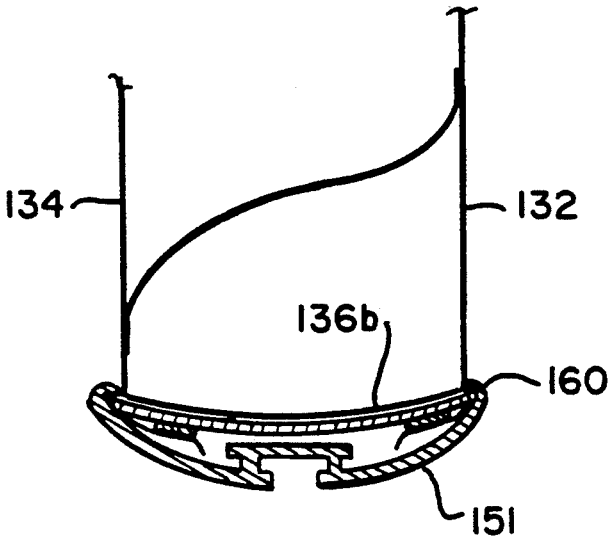

The bottom portion of the window covering 130 is secured to the bottom rail assembly 150 simply and easily as shown in FIGS. 12*a* and 12*b*. A thin slat 160 of stiff and resilient material, such as aluminum or a suitable plastic material, is placed against the downwardly facing side of the lowermost vane 136*b*. The ends of first fabric 132 and second fabric 134 are at least temporarily secured to the underside of the thin slat 160 by transfer tape 162. The thin slat 160 with the ends of fabrics 132 and 134 secured thereto is then press or snap fit into the bottom rail 151 by exerting a bending force on the thin slat 160. The width of thin slat 160 is greater than the distance between the surfaces 168, 170 of curved edges 164, 166, respectively of the bottom rail 151. The thin slat 160, because of its resiliency, is bent or curved to fit under curved edges 164, 166 and upon releasing the bending force on the slat 160, curved edges 164, 166 of the bottom rail 151 retain the thin slat 160 in the bottom rail 151 and securely hold the ends of the fabrics 132 and 134 inside the bottom rail assembly 150. Preferably, the thin slat 160 is bent or curved about 30° for snap-in and curves back or loses part of its curve after having been snapped in. In one embodiment of the invention, the thin slat 160 remains curved at about 20° after having been snapped in. The fact that the thin slat remains curved after snapping it into the bottom rail makes the width of the slat far less critical. The amount cf the curvature is not critical.

The curved or C-shaped structure of bottom rail assembly 150 is important for several reasons. First, the curved shape allows the bottom rail assembly to roll up behind the rolled up fabric of the window covering in a minimum amount of space (see FIG. 14*a*). Further, the curved structure of the bottom rail imparts a curve to the snap in slat, by applying tension to the ends of the slat. The outward force exerted by the curve of the slat against the curved edges of the bottom rail holds the fabric tightly at these points. Finally, the curve in the slat also makes up for the distance differences between the front and rear fabrics caused by the extent of travel of the respective fabrics around the ends of the slat and, more importantly, the ends of the slat exert an outward pressure at the inside edges 166, 164 of the bottom rail 151.

Figure 13:
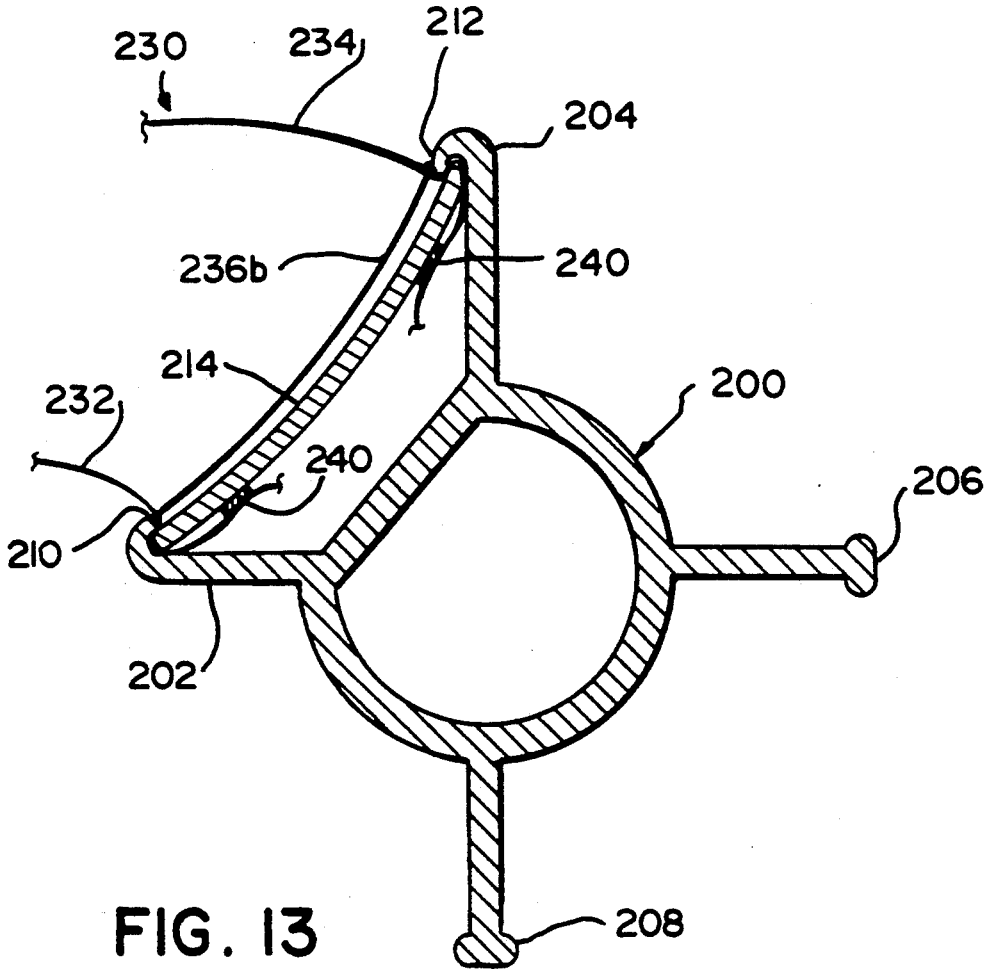
FIG. 13 is a cross-sectional view of another embodiment of a head roller according to the present invention.

In another embodiment, shown in FIG. 13, two adjacent lobes or projections 202, 204 of the head roller 200 are provided with curved, retaining edges 210, 212, respectively. Remaining lobes 206, 208 may be of any suitable configuration, such as rounded projections as shown in FIG. 13. The lobes 202, 204 cooperate with a thin slat 214 of a stiff, springy material to secure the top ends of the first fabric 232 and the second fabric 234 of the window covering 230 to the head roller 200. The top ends of the first and second fabrics 232, 234 are secured to the head roller 200 in the same way the bottom ends of the first and second fabrics 132, 134 are secured to the bottom rail assembly 150 in the embodiment of FIG. 11, as shown in FIGS. 12*a* and 12*b*. That is, one surface of the thin slat 214 is held against the upper surface of uppermost vane 236*a* and then the ends of the first fabric 232 and the second fabric 234 are at least temporarily secured to the other surface of the thin slat 214 by transfer tape 240. Then, the thin slat 214, with the window covering 230 at least temporarily secured thereto is press or snap fit between the lobes 202, 204 of the head roller 200 by exerting a bending force on the thin slat 214. When the bending force is released, the thin slat 214 straightens out somewhat and is retained in place on the head roller 200 by the curved retaining edges 210, 212 of the lobes 202, 204, respectively, thereby securing the window covering 230 to the head roller 200. As shown in FIG. 13, the thin slat 214 preferably remains curved after it has been snapped into the head roller 200, so that the slat 214 exerts an outward pressure force against the inner portions of the retaining edges 210, 212 of the lobes 202, 204, respectively. Further, the curved slat provides an accommodation space for the window covering when it is rolled up. The degree of curvature of the slat 214 is not critical and the slat may be substantially straight after being snapped into the head roller.

A fabric light control window covering deployed such as in the present invention is operated by first unrolling the window covering and then continuing to rotate the head roller in order to articulate the vanes. However, if the head roller is rotated in the unroll direction beyond a certain point the window covering will begin to roll up in the wrong direction. This will cause the vanes to bend back on themselves and possibly form creases in the vanes which could create an uneven appearance or impair the operation of the window covering. Also, with the vanes bent back over themselves the window covering will be extremely bulky when rolled up and may not fit into the space allotted for the head roller. Thus, the present invention provides a flip-catch mechanism 60 for preventing wrong-way roll up of the window covering. It will readily be appreciated by those skilled in the art that the flip-catch mechanism is useful for roller shades of all types in which it is desired to prevent wrong-way roll up.

Flip-catch mechanism 60 includes arm 62 which is secured to the head roller by hinged attachment 64. Also provided is a cooperating stop 66 which may be included as part of an associated valence 65. Arm 62 is movable between a first position engaging stop 66 and a second position, indicated in dotted lines at 62*a*, resting in one of the recesses 18 between lobes 16.

Figure 4A:
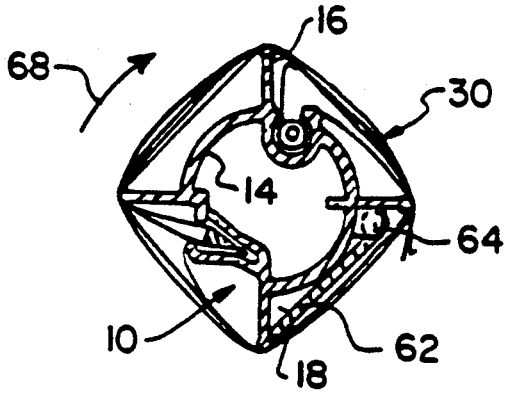
FIGS. 4*a–c* are cross-sectional views of a head roller and flip-catch mechanism according to the present invention, sequentially illustrating the operation of the flip-catch mechanism.
Figure 4B:
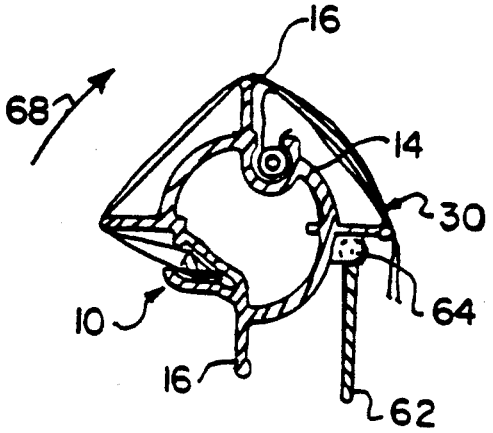
Figure 4C:
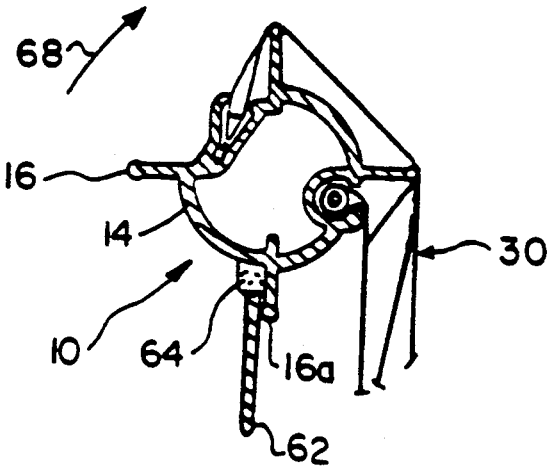

The operation of flip-catch device 60 is illustrated in FIG. 4*a–c*. Beginning with FIG. 4*a*, arm 62 is in the second position resting in recess 18 with window covering 30 wrapped around head roller assembly 10. Window covering 30 is unrolled by rotating the head roller assembly 10 in the direction indicated by arrow 68. Arm 62 is retained in the second position by window covering 30 being wrapped around head roller assembly 10 as the window covering is unrolled. As shown in FIG. 4*b*, once the window covering has been unrolled to the point where it no longer extends completely around head roller assembly 10, arm 62 moves from the second position, between the lobes, due to the force of gravity as it is rotated around the bottom of head roller assembly 10. Further rotation of head roller assembly 10, in the direction of arrow 68, causes arm 62 to engage lobe 16*a* as shown in FIG. 4*c*. Still further rotation of head roller assembly 10 in the same direction brings arm 62 into contact with stop 66 and thus prevents further rotation of head roller assembly 10 in that direction, as shown in FIG. 3. When the window covering is rolled up, rotation of the head roller assembly 10 in the opposite direction of arrow 68 automatically causes arm 62 to move back into the second position inside window covering 30 and resting between lobes 16.

Figure 7A:
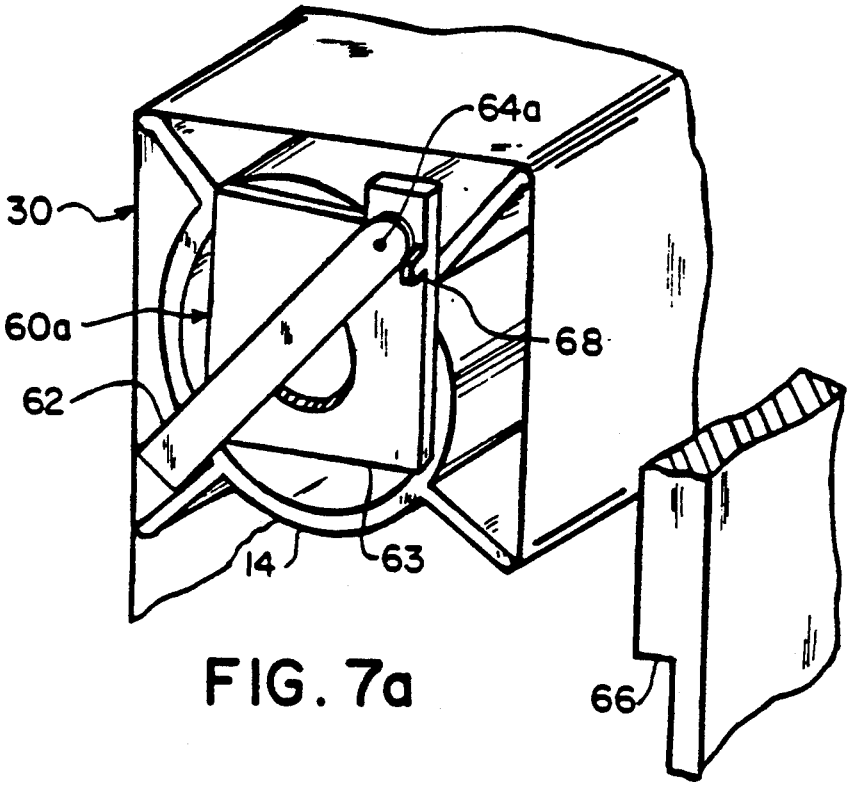
FIGS. 7*a–b* are perspective end views of a roller and roller end cap provided with a flip-catch device according to a preferred embodiment of the invention.
Figure 7B:
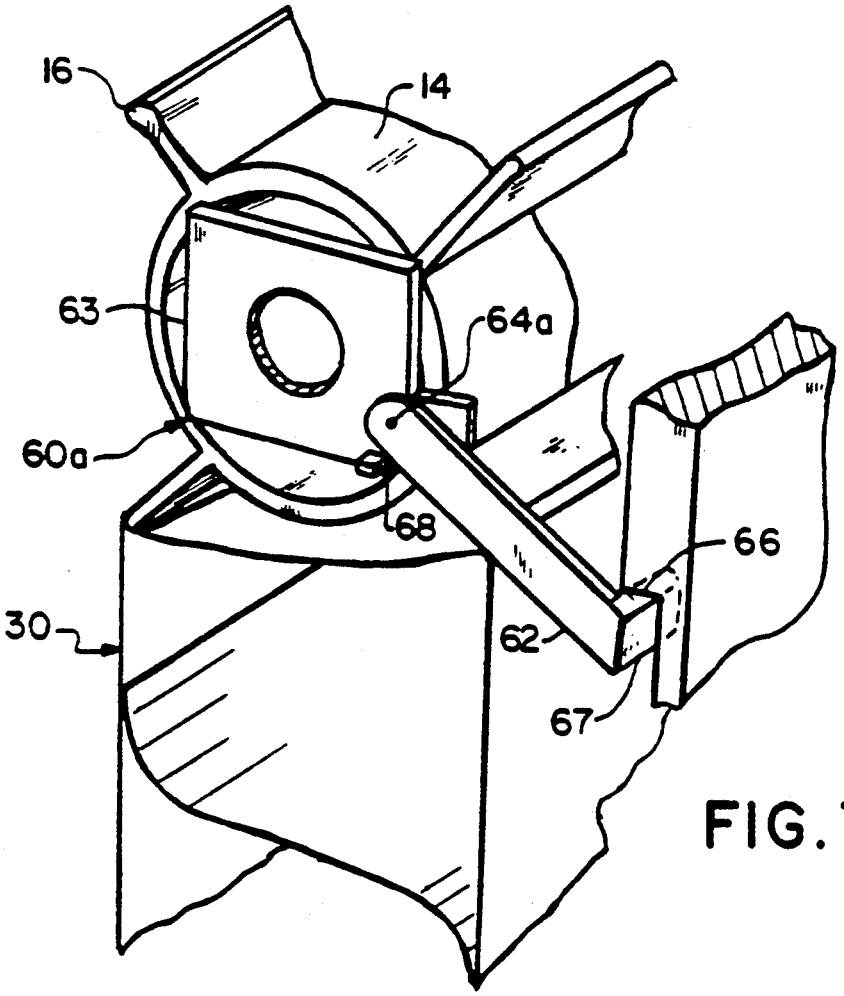

In a preferred embodiment, the flip-catch mechanism may be provided as an end cap 60*a*, shown in FIGS. 7*a–b*. FIG. 7*a* illustrates the second position and FIG. 7*b* the first position referred to above. Arm 62 is provided on base 63 with pivotable connection 64*a*. Base 63 is shaped to be inserted into support member 14 and engage support member 14 without relative rotation. In this arrangement arm 62 is disposed beyond the end of support member 14, therefore inwardly directed tab 67 is provided at the end of arm 62*a* to catch on window covering 30 and cause arm 62 to be moved from the second to the first position when the window covering is rolled up. The attachment means for the window covering 30 are not shown in FIGS. 7*a–b* in order to clearly illustrate the flip-catch mechanism. Stop tab 68 extends from base 63 to limit the travel of arm 62 in the first position, engaging stop 66. In this embodiment arm 62*a* may be longer because it does not have to fit between lobes 16.

The present invention further provides an alternative top-catch mechanism 350 for preventing wrong way roll up and down of the window covering. Top-catch mechanism 350 also prevents jamming of the head roller assembly which can be caused by rotating the head roller too far in the proper roll up direction, thereby causing the bottom rail assembly or assemblies to rotate around the head roller and become jammed between the valance and the head roller. It will be readily appreciated by those skilled in the art that the top-catch mechanism is useful for roller shades of all types in which it is desired to prevent wrong-way roll up and/or over rotation of the head roller in the proper roll up direction. Top-catch mechanism 350 and flip-catch device 60 provide alternative means to prevent wrong way roll up of a window covering.

Figure 14C:
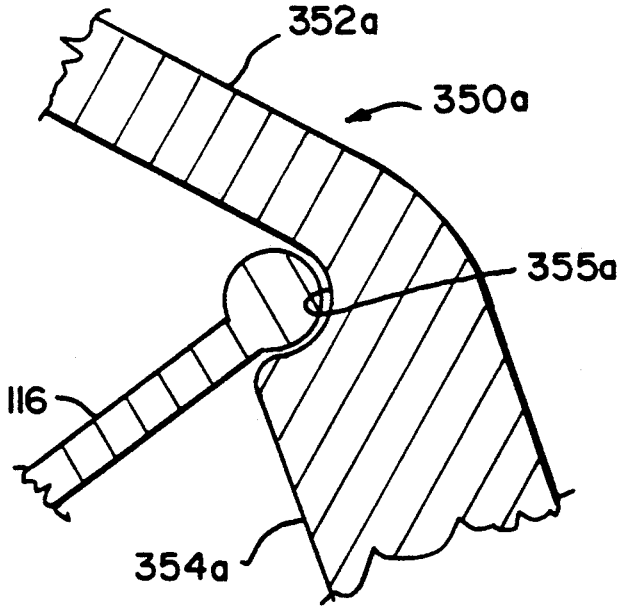
FIG. 14*c* is an enlarged cross-sectional view of a portion of an alternate embodiment of the top-catch mechanism according to the present invention.
Figure 14A:
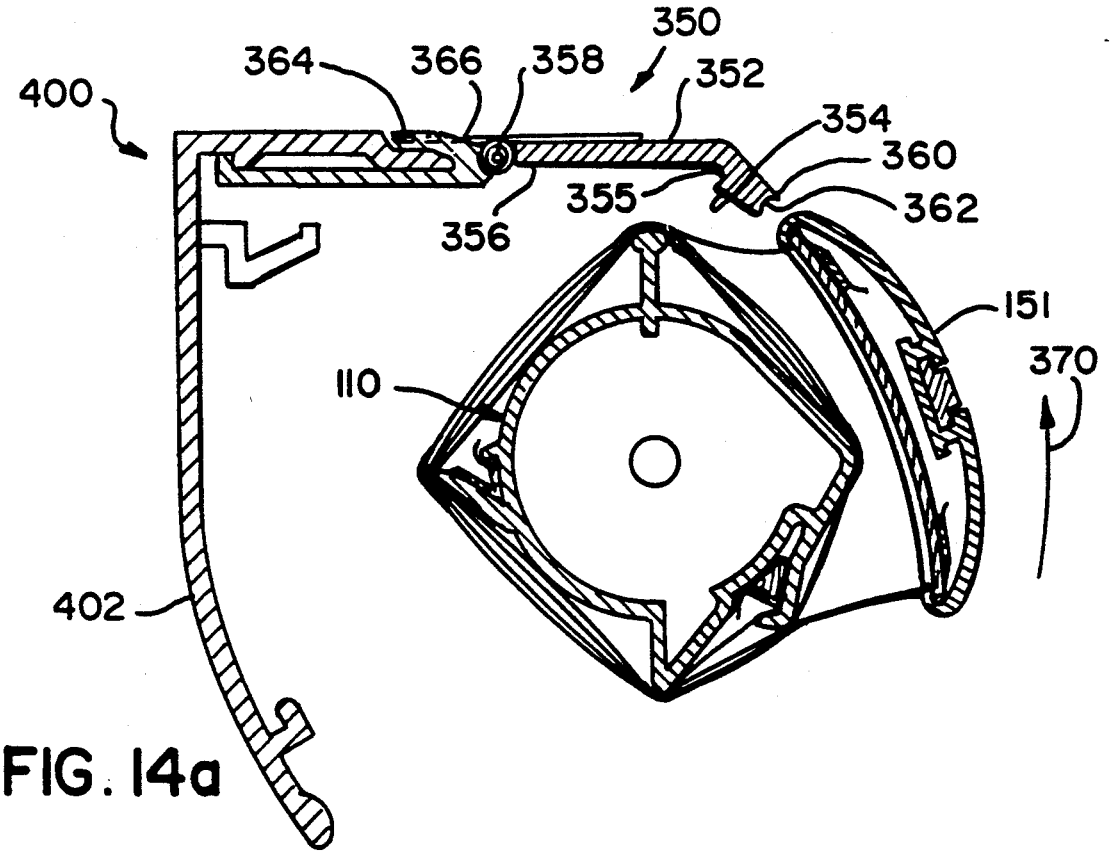
FIGS. 14*a* and 14*b* are cross-sectional views of a head roller and top-catch mechanism according to the present invention, illustrating the operation of the top-catch mechanism.
Figure 14B:
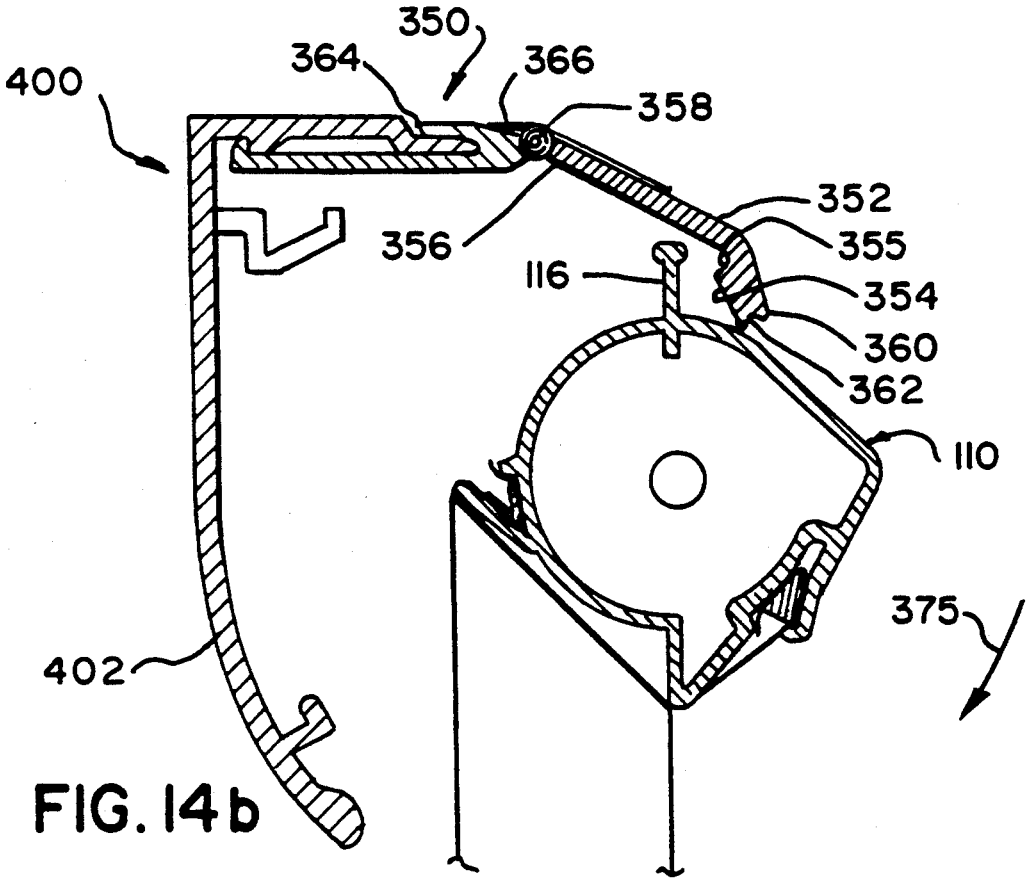

As shown in FIGS. 14*a* and 14*b*, top-catch mechanism 350 includes a swing arm 352 having a downwardly extending terminal portion 354. The end 356 of the swing arm 352 opposite the terminal portion 354 is pivotally mounted such that swing arm 352 pivots around pivot point 358 and such that swing arm 352 and connecting arm 364 are hinged freely relative to one another. Preferably, the edge 360 of the terminal portion 354 has a curved channel 362 formed therein. In the embodiment shown in FIGS. 14*a* and 14*b*, the top-catch mechanism 350 is carried by the valance 400 and is connected to the valance 400 by connecting arm 364.

The top-catch mechanism 350 also includes spring means 366 which exerts a light downward spring force against the swing arm 352 and thus biases the swing arm 352 toward the head roller 110.

The operation of top-catch mechanism 350 is illustrated in FIGS. 14*a–b*. Beginning with FIG. 14*a*, the window covering 130 is in the completely rolled up state and further rotation of the head roller 110 in the roll up direction, indicated by arrow 370, is prevented by the top-catch mechanism 350. As seen in FIG. 14*a*, the downward spring force exerted by spring means 366 biases the lower surface of the terminal portion 354 of the swing arm 352 toward the rolled u fabric of the window covering 130. The edge of the bottom rail 151 abuts against the edge 360 of the terminal portion 354 of the swing arm 352, preventing further rotation of the head roller 110. Preferably, as shown in FIG. 14*a*, the channel 362 formed in the terminal portion 354 of the swing arm 352 and the outer edge of the bottom rail 151 are complementarily shaped so that the bottom rail 151 abuts securely against the terminal portion of the swing arm 352 and the channel 362 positively grabs the outer ends of the bottom rail 151 without sliding off and without scratching or marring of any decorative finish on the bottom rail.

Window covering 130 is unrolled by rotating the head roller assembly 110 in the direction indicated by arrow 375. The downward spring force applied to swing arm 352 by spring means 366 is light enough that as the window covering 130 is unrolled, the lower surface of the terminal portion 354 passes along the surface of the outermost layer of rolled fabric. The pivot point permits the swing arm to move up and down as required by the irregular configuration of the outer surface of the rolled fabric. As shown in FIG. 14*b*, after the window covering 130 has been completely unrolled, the shoulder 355 of the terminal portion 354 of the swing arm 352 contacts the lobe 116 of the head roller assembly 110, preventing further rotation of the head roller 110 in the wrong roll up direction. FIG. 14*c* is an enlarged view of a portion of an alternate embodiment of the top-catch mechanism 350*a*, showing the end of the lobe 116 contacting the shoulder 355*a* of the terminal portion 354*a* of the swing arm 352*a*. In this embodiment, the shoulder 355*a* of the top-catch mechanism 350*a* has a shape complementary to that of the end of the lobe 116.

Figure 15:
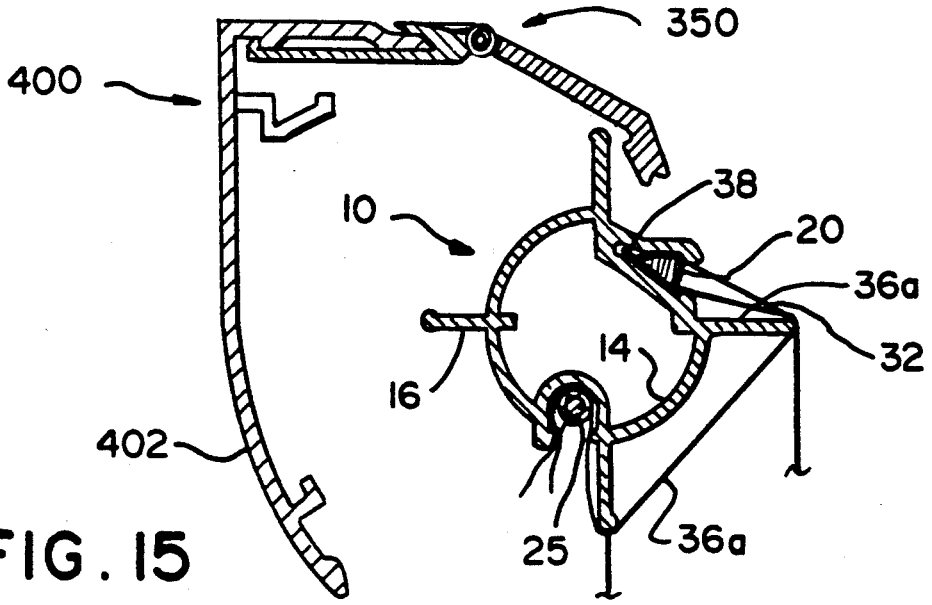
FIG. 15 is a cross-sectional view of another embodiment of a head roller and top-catch mechanism according to the present invention.
Figure 16:
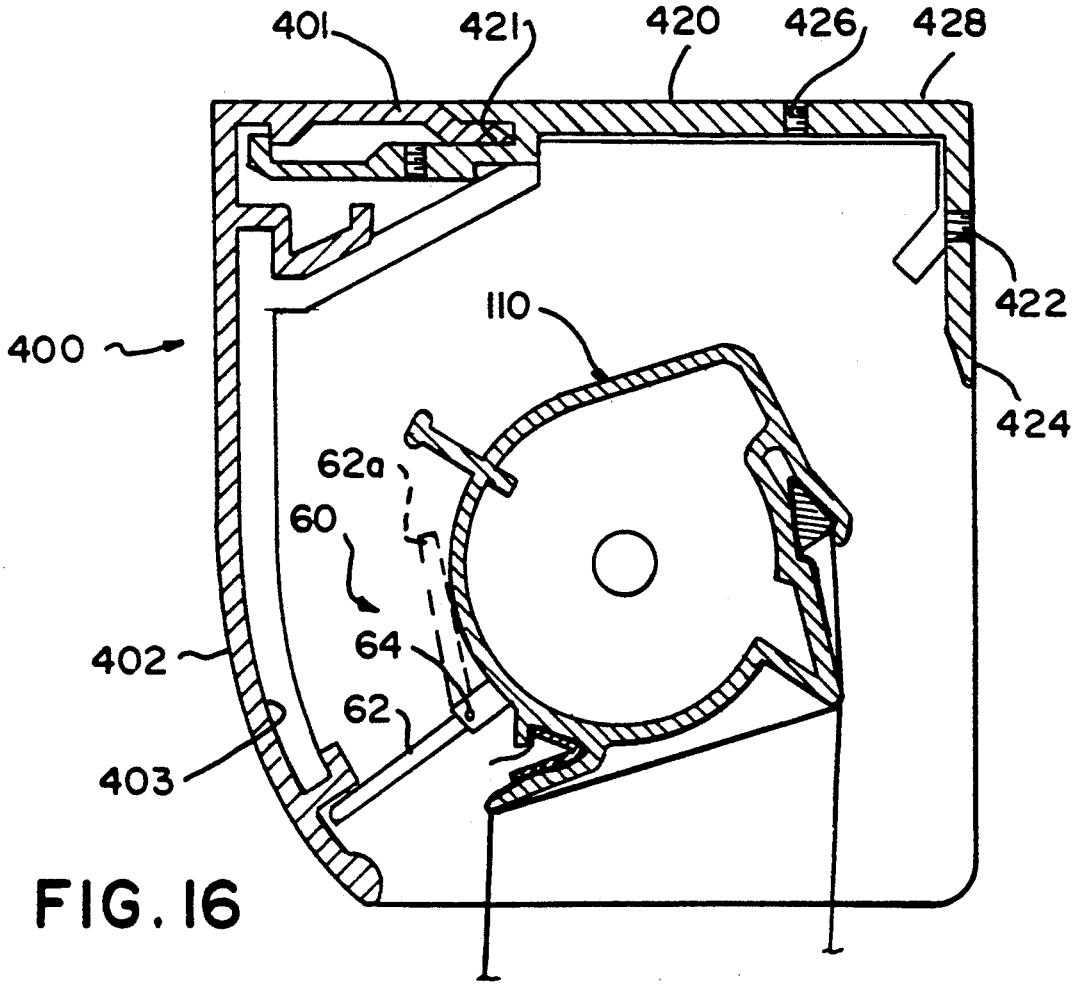
FIG. 16 is a cross-sectional view of another embodiment of a head roller and flip-catch mechanism according to the present invention.

As shown in FIGS. 15 and 16, respectively, the top-catch mechanism 350 can be used in conjunction with head roller 10 and valance 400, and flip-catch mechanism 60 can be used together with head roller 110 and valance 400 to prevent wrong way roll up. Although various embodiments and aspects of the present invention have been described, including specific combinations of head rollers, bottom rails, valances and means for preventing wrong way roll up of window coverings, it is to be understood that the individual components of the inventive mounting apparatus may be combined in any desired combination, not just the exemplary combinations specifically described above.

The description of the preferred embodiments contained herein is intended in no way to limit the scope of the invention. As will be apparent to a person skilled in the art, modifications and adaptations of the structure and method of the above-described invention will become readily apparent without departure from the spirit and scope of the invention, the scope of which is described in the appended claims.

What is claimed is:

1. A roller for a retractable covering device having at least two layers of flexible material which are wound around said roller simultaneously when said covering device is being retracted and a plurality of adjustable vanes attached to said layers along attachment lines, said roller being rotatable about a longitudinal axis and comprising an elongated support member including means for attaching said covering device and at least two longitudinal projections extending outwardly from said support member, said projections providing contact points to space a wound up covering device away from said support member and said projections defining at least two unobstructed recesses around the periphery of said support member to provide areas in which the wound up covering device is not compressed such that buckles which develop between the layers of said wound up covering device fall within said unobstructed recesses, said attaching means including:

a recess formed in said support member for receiving a line of attachment between a first of said layers of flexible material and one of said plurality of adjustable transverse vanes, said recess being parallel to the roller axis; and means for holding said line of attachment in said recess.

2. The roller according to claim 1, wherein said holding means comprises:

a longitudinal channel formed in the support member, said channel having an outwardly directed longitudinal opening allowing for entry of said first layer and said vane with said recess of said attaching means opening into said longitudinal channel opposite said longitudinal opening thereof; and an elongated member shaped to be placed in said longitudinal channel and cooperate with said longitudinal channel to engage said first layer and said vane in said longitudinal channel and hold said line of attachment in said recess of said attaching means.

3. The roller according to claim 1, wherein said holding means comprises:

a longitudinal channel having a triangular cross-section defined by the support member and a projection thereof, said triangular channel having an outwardly directed longitudinal opening along its base and a longitudinally extending vertex opposite said opening with said recess lying in said vertex; and an elongated wedge shaped member which cooperates with said vane and said first layer to force said line of attachment between said vane and said first layer into the vertex of said triangular channel to ensure parallel alignment of said vanes with said roller.

4. The roller according to claim 1, further comprising separate means for attaching said second layer, including:

a longitudinal channel formed in said support member having a V-shaped cross-section with an inward projection of one of the legs of the V-shape; and a resilient V-shaped strip, one leg of which engages behind said projection when placed in said V-shaped channel, whereby the second layer is wrapped at least partially around the V-shaped strip and engaged in the channel by the V-shaped strip.

5. The roller according to claim 1, further comprising separate means for attaching said second layer including:

a longitudinal channel having a circular cross-section with a longitudinal opening having a width less than the diameter of the channel; and a resilient tubular member which is compressible for placement through said opening, whereby the second layer is wrapped at least partially around the tubular member and engaged in the channel by the tubular member.

6. A roller as defined in claim 1, further comprising:

a stop support member separately spaced from and fixed relative to said elongated support member; and a catch member pivotally mounted on said stop support member and biased toward said support member such that as said shade is unwound from said support member said catch member contacts an outer surface of the wound up portion of the shade and when the shade is completely unwound said catch member engages one of said projections to prevent rotation of said support member past a predetermined point.

7. A roller as defined in claim 6, wherein said covering device includes a stiff bottom rail, and said catch member defines a channel for receiving said bottom rail, whereby when said covering device is completely wound up around said roller said bottom rail engages within said channel of said catch member to prevent further rotation of said roller in the rolling up direction.

8. A roller for a retractable covering device having at least two layers of flexible material which are wound around said roller simultaneously when said covering device is being retracted, said roller being rotatable about a longitudinal axis and comprising an elongated support member including means for attaching said covering device and at least two longitudinal projections extending outwardly from said support member, said projections providing contact points to space a wound up covering device away from said support member and said projections defining at least two unobstructed recesses around the periphery of said support member to provide areas in which the wound up covering device is not compressed such that buckles which develop between the layers of said wound up covering device fall within said unobstructed recesses, said attaching means comprising:

two of said projections of said roller, each of said two projections terminating in a retaining edge spaced apart from said support member, and an elongated strip extending between the retaining edges of said two projections and retained thereby, the upper edge portions of the at least two layers of flexible material extending around respective longitudinal edges of said elongated strip and being secured between said two projections and said elongated strip by pressure exerted by said elongated strip against said two projections to securely attach said covering device to said roller.

9. The roller according to claim 8, wherein said elongated strip is retained by the retaining edges of said two projections such that said elongated strip is curved.

10. A roller for a retractable covering device having at least two layers of flexible material which are wound around said roller simultaneously when said covering device is being retracted, said roller having an associated stop member, said stop member being separate from and fixed relative to said roller, said roller comprising an elongated support member including means for attaching said covering device and at least two longitudinal projections extending outwardly from said support member, said projections providing contact points to space a wound up covering device away from said support member and said projections defining at least two unobstructed recesses around the periphery of said support member to provide areas in which the wound up covering device is not compressed such that buckles which develop between the layers of said wound up covering device fall within said unobstructed recesses, said roller further comprising a catch member pivotally mounted on said support member and engageable with said stop member, said catch member being movable between a first position pivoted inward and accommodated at least partially inside said wound up covering device when wound around said roller, and a second position pivoted outward and engaging said stop member whereby as the covering device is unwound from the roller said catch member is uncovered and pivots outward from said support member to engage said stop member and thereby stops rotation of said roller past a predetermined point, and whereby as the covering device is wound around said roller said catch member pivots in against said support member and is accommodated at least partially inside the covering device when wound further onto the roller.

11. The roller according to claim 10, wherein the catch member is pivotably connected to an end cap inserted into an end of said support member, said catch member being disposed beyond the end of said support member and having an inwardly directed tab for engaging and being accommodated inside said covering device.

12. A roller for a covering device having first and second parallel, flexible sheets of material and a plurality of adjustable transverse vanes attached to said sheets along attachment lines, said vanes being carried between and connecting said sheets, said roller having an associated stop member, said stop member being separate from and fixed relative to said roller, said roller comprising:

an elongated support member including a surface which is discontinuous to provide areas for receiving buckles of said sheets and vanes which result from rolling up said covering device;

means for attaching said first sheet to said support member, including a recess formed in said support member for receiving the line of attachment between the first sheet and a vane, said recess being parallel to the roller axis, and means for holding said line of attachment in said recess;

means for attaching said second sheet to said support member; and a catch member pivotally connected to said support member and engageable with said stop member, said catch member being movable between a first position pivoted inward and accommodated at least partially inside said covering device when rolled around said roller, and a second position pivoted outward and engaging said stop member, whereby as the covering device is unwound from the roller said catch member is uncovered and pivots outward from said support member to engage said stop member and thereby stop rotation of said roller past a predetermined point, and whereby as the covering device is wound onto said roller said catch member pivots in against said support member and is accommodated at least partially inside the covering device when rolled further onto the roller.

13. The roller according to claim 12, wherein said holding means comprises:

a longitudinal channel having a triangular cross-section defined by the support member and a projection thereof, said triangular channel having an outwardly directed longitudinal opening along its base and a longitudinally extending vertex opposite said opening with said recess lying in said vertex; and an elongated wedge shaped member which cooperates with said vane and said first sheet to force said line of attachment between said vane and said first sheet into the vertex of said triangular channel to ensure parallel alignment of said vanes with said roller.

14. A bottom rail for a covering device having first and second parallel sheets of material and a plurality of adjustable transverse vanes attached to said sheets along attachment lines, said vanes carried between and connecting said sheets, said bottom rail comprising:

an elongated member having a recess formed therein for receiving the line of attachment between one of said first and second sheets and a vane, said recess being parallel to the longitudinal direction of the elongated member; and means for holding said line of attachment in said recess, said holding means including a longitudinal channel formed in said elongated member having an outwardly directed longitudinal opening, said longitudinal channel having a triangular cross-section defined by the elongated member with said outwardly directed longitudinal opening along its base and a longitudinally extending vertex opposite said opening, with said recess lying in said vertex, said holding means further comprising:

an elongated wedge shaped member which cooperates with said vane and said one of said sheets to force said line of attachment between said vane and said sheet into the vertex of said triangular channel to ensure parallel alignment of said vanes with said bottom rail.

15. A bottom rail for a roller shade defining a bottom edge, comprising;

an elongated member attached to said shade along said bottom edge thereof; and a weight adjustably carried by said elongated member separately from said bottom edge of said shade, the position of said weight being adjustable along said elongated member transversely with respect to said shade, whereby the transverse position of the weight may be readily adjusted to prevent skewing of said shade when the same is rolled up.

16. A bottom rail as defined in claim 15, wherein said elongated member defines a channel in spaced parallel relation to said shade bottom edge and said weight is slidably mounted in said channel.

17. A bottom rail for a roller shade having a bottom edge, said rail comprising an elongated member attached to said shade along said bottom edge thereof, said elongated member having a pair of diverging legs defining a longitudinal channel having a V-shaped cross-section, an inward projection on one of said legs;

a resilient V-shaped strip having a pair of diverging legs, one leg of said strip engaging behind said projection when said strip is placed in said V-shaped channel whereby when said shade material is wrapped at least partially around said V-shaped strip and inserted with said V-shaped strip in said channel, said shade material is securely attached to said elongated member; and a weight adjustably carried by said elongated member, the position of said weight being adjustable transversely with respect to said shade, whereby the transverse position of the weight may be readily adjusted to prevent skewing of said shade when the same is rolled up.

18. A bottom rail for a roller shade having a bottom edge, said rail comprising an elongated member attached to said shade along said bottom edge thereof, said elongated member defining a longitudinal channel of circular cross-section, said channel having an opening smaller than the inside diameter of said channel;

a resilient tubular clamping member for clampingly engaging said shade in said longitudinal channel with a portion of said shade wrapped around said member and said member and wrapped shade portion forceably inserted through said opening; and a weight adjustably carried by said elongated member, the position of said weight being adjustable transversely with respect to said shade, whereby the transverse position of the weight may be readily adjusted to prevent skewing of said shade when the same is rolled up.

19. A bottom rail for a roller shade having a bottom edge, said rail comprising an elongated member attached to said shade along said bottom edge thereof, said elongated member defining a longitudinal channel of substantially C-shaped cross section with opposed longitudinal inward projections;

a resilient elongated strip for securing said shade in said longitudinal channel with an edge portion of said shade wrapped at least partially around said elongated strip and said elongated strip and wrapped shade portion inserted into said longitudinal channel whereby said elongated strip engages behind said longitudinal inward projections and exerts pressure thereon to retain said wrapped shade portion; and a weight adjustably carried by said elongated member, the position of said weight being adjustable transversely with respect to said shade, whereby the transverse position of the weight may be readily adjusted to prevent skewing of said shade when the same is rolled up.

20. The bottom rail according to claim 19, wherein when said elongated strip is engaged behind said longitudinal inward projections, said elongated strip is transversely bowed.

21. A device for preventing a roller shade roller from rolling up the wrong way, comprising:

a stop member spaced away from said roller and fixed with respect to said roller; and a catch member pivotally mounted on said roller and movable between a first position pivoted inward and accommodated at least partially inside said shade when rolled around said roller, and a second position pivoted outward and engaging said stop member, whereby as the shade is unwound from the roller said catch member is uncovered and pivots outward from said roller to engage said stop member and thereby stop rotation of said roller past a predetermined point, and whereby as the shade is wound onto said roller said catch member pivots in against said roller and is accommodated at least partially inside the shade when wound further around the roller.

22. The device according to claim 21, further comprising a base member carrying said catch member and adapted to be mounted on an end of said roller, said catch member having an inwardly directed tab for engaging and being accommodated inside said shade.

23. A roller shade including the device according to claim 21.

24. The roller shade according to claim 23, wherein said roller shade includes first and second parallel sheets and a plurality of adjustable transverse vanes attached to said sheets along attachment lines, said vanes being carried between and connecting said sheets.

25. A device for use with a shade secured to a shade roller for preventing said shade roller from rolling up the wrong way, said shade having a stiff bottom rail, and said roller comprising an elongated support member with at least one projection extending radially therefrom, said device comprising:

a connecting member separately spaced away from said roller and fixed with respect to said roller;

a catch member pivotally mounted on said connecting member and biased toward said roller such that as said shade is unwound from said roller, said catch member contacts an outer surface of said wound up portion of said shade and, when said shade is completely unwound, said catch member engages said projection extending from said support member to prevent rotation of said roller past a predetermined point; and said catch member having a channel defined there for receiving said bottom rail of said shade when said shade is completely wound up around said roller to prevent further rotation of said roller in the rolling up direction.

26. A retractable covering device, comprising:

a light control element having first and second parallel sheets and a plurality of adjustable transverse vanes carried by and mounted between said sheets; and roller means for rolling and unrolling said light control element without creating wrinkles or creases in said light control element, said roller means including means for attaching said light control element, said roller means being rotatable about a longitudinal axis and including a surface which is discontinuous to provide areas to receive buckles of said sheets and vanes which result from rolling up said light control element, said discontinuous surface being formed by a plurality of projections of said roller means, said projections defining recesses therebetween for receiving said buckles and having line contact with said light control element transversely across said sheets.

27. A retractable covering device, comprising:

a light control element having first and second parallel sheets and a plurality of adjustable transverse vanes attached to said sheets along lines of attachment; and roller means for rolling and unrolling said light control element without creating wrinkles or creases in said light control element, said roller means including means for attaching said light control element, said roller means being rotatable about a longitudinal axis and said roller attaching means including:

a recess defined by the roller means for receiving the line of attachment between the first sheet and a vane, said recess being parallel to said longitudinal axis; and means for holding said line of attachment in said recess, said holding means comprising:

a longitudinal channel having a triangular cross-section defined by the roller means and a projection thereof, said triangular channel having an outwardly directed longitudinal opening along its base and a longitudinally extending vertex opposite said opening, with said recess lying in said vertex, and an elongated wedge shaped member which cooperates with said vane and said first sheet to force said line of attachment between said vane and said first sheet into the vertex of said triangular channel to ensure parallel alignment of said vanes with said roller; and said roller means includes separate means for attaching said second sheet, including a longitudinal channel formed in said support member having a V-shaped cross-section with an inward projection of one of the legs of the V-shape, and a resilient V-shaped strip, one leg of which engages behind said projection when placed in said V-shaped channel, whereby the second sheet is wrapped at least partially around the V-shaped strip and engaged in the channel by the V-shaped strip.

28. A retractable covering device, comprising:

a light control element having first and second parallel sheets and a plurality of adjustable transverse vanes carried by and mounted between said sheets; and roller means rotatable about a longitudinal axis for rolling and unrolling said light control element without creating wrinkles or creases in said light control element, said roller means including means for attaching said light control element and said roller means including a discontinuous surface formed by a plurality of projections extending radially outwardly, said projections defining recesses therebetween for receiving buckles of said sheets and vanes which result from rolling up said light control element, said roller attaching means comprising:

two of said projections of said roller means, each of said two projections terminating in a retaining edge, and an elongated strip extending between the retaining edges of said two projections and retained thereby, the upper edge portions of the first and second sheets extending around respective longitudinal edges of said elongated strip and being held between said two projections and said elongated strip by pressure exerted by said elongated strip against said two projections to securely attach said covering device to said roller means.

29. The covering device according to claim 28, wherein said elongated strip is retained by the retaining edges of said two projections such that said elongated strip is curved.

30. A retractable covering device, comprising:

a light control element having first and second parallel sheets each defining a bottom edge, and a plurality of adjustable spaced apart transverse vanes carried by and mounted between said sheets;

roller means for rolling and unrolling said light control element without creating wrinkles or creases in said light control element, said roller means including means for attaching said light control element thereto, said roller means being rotatable about a longitudinal axis;

an elongated member attached to said light control element along the bottom edge of at least one of said sheets; and a weight adjustably carried by said elongated member separately from said sheet bottom edge, the position of said weight being adjustable along said elongated member transversely with respect to said light control element to compensate for skewing of said light control element when the same is rolled on said roller means.

31. The covering device according to claim 30, wherein said elongated member defines a channel extending therein in spaced parallel relation to said sheet bottom edge, said channel having a shape complementary to said weight with said weight slidable therein.

32. A retractable covering device, comprising:

a light control element having first and second parallel sheets each defining a bottom edge, and a plurality of adjustable spaced apart transverse vanes carried by and mounted between said sheets;

said transverse vanes of the light control element being attached to said sheets along lines of attachment;

roller means for rolling and unrolling said light control element without creating wrinkles or creases in said light control element, said roller means including means for attaching said light control element thereto, said roller means being rotatable about a longitudinal axis;

an elongated member attached to said light control element along the bottom edge of at least one of said sheets;

said elongated member being attached to said first sheet, and said covering device further comprising a second elongated member having a recess formed in said member for receiving the line of attachment between said second sheet and a vane, said recess being parallel with said member;

means for holding said line of attachment in said recess; and a weight adjustably carried by said elongated member, the position of said weight being adjustable transversely with respect to said light control element to compensate for skewing of said light control element when the same is rolled on said roller means.

33. A retractable covering device, comprising:

a light control element having first and second parallel sheets each defining a bottom edge, and a plurality of adjustable spaced apart transverse vanes carried by and mounted between said sheets;

roller means for rolling and unrolling said light control element without creating wrinkles or creases in said light control element, said roller means including means for attaching said light control element thereto, said roller means being rotatable about a longitudinal axis;

an elongated member attached to said light control element along the bottom edges of both of said sheets, said elongated member defining a longitudinal channel of substantially C-shaped cross section with opposed longitudinal inward projections;

a resilient elongated strip securing said light control element in said longitudinal channel with the edge portions of said first and second sheets wrapped around respective longitudinal edges of said elongated strip and the same inserted into said longitudinal channel whereby said elongated strip extends across said longitudinal channel and each longitudinal edge of said elongated strip engages behind one of said longitudinal inward projections and exerts pressure thereon; and a weight adjustably carried by said elongated member, the position of said weight being adjustable transversely with respect to said light control element to compensate for skewing of said light control element when the same is rolled on said roller means.

34. The covering device according to claim 33, wherein when said elongated strip is engaged behind said longitudinal inward projections, said elongated strip is transversely bowed.

35. A retractable covering device, comprising:

a light control element having first and second parallel sheets and a plurality of adjustable transverse vanes carried by and mounted between said sheets; and roller means for rolling and unrolling said light control element without creating wrinkles or creases in said light control element, said roller means including means for attaching said light control element, said roller means being rotatable about a longitudinal axis; and a catch member pivotally connected to said roller means and movable between a first position pivoted inward and accommodated at least partially inside said light control element when rolled around said roller means, and a second position pivoted outward and engaging an associated stop member fixed relative to said roller means, whereby as the light control element is unrolled from the roller means said catch member is uncovered and pivots outward from said roller means to engage said stop member and thereby stop rotation of said roller means past a predetermined point, and whereby as the light control element is rolled onto said roller means said catch member pivots in against said roller means and is accommodated at least partially inside the light control element when rolled further onto said roller means.

36. A retractable covering device, comprising:

a light control element having first and second parallel sheets and a plurality of adjustable transverse vanes carried by and mounted between said sheets; and roller means for rolling and unrolling said light control element without creating wrinkles or creases in said light control element, said roller means including means for attaching said light control element, said roller means being rotatable about a longitudinal axis and said roller means including a discontinuous surface formed by a plurality of projections extending radially outwardly, said projections defining recesses therebetween for receiving buckles of said sheets and vanes which result from rolling up said light control element; and a device for preventing the light control element from rolling up the wrong way, said device including a connecting member spaced away from said roller means and fixed with respect to said roller means; and a catch member pivotally mounted on said connected member and biased toward said roller means such that as the light control element is unrolled from the roller means, the catch member contacts an outer surface of the rolled up portion of the light control element and when the light control element is completely unrolled, the catch member engages one projection extending from the roller means to prevent rotation of said roller means past a predetermined point.

37. The covering device according to claim 36, further comprising a bottom rail attached along a bottom edge of at least one of said first and second sheets of said light control element, and wherein said catch member has a channel provided therein such that when the light control element is completely wound up around the roller means, said bottom rail of the light control element engages the channel of the catch member to prevent further rotation of the roller means in the rolling up direction.

38. A retractable covering device, comprising:

a light control element having first and second parallel sheets and a plurality of adjustable transverse vanes attached to said sheets along attachment lines, said vanes being carried between and connecting said sheets; and roller means for rolling and unrolling said light control element including a surface which is discontinuous to provide areas to receive buckles of said sheets and vanes which result from rolling up said light control element, said roller means being rotatable about a longitudinal axis and said roller means further including first and second means for attaching said light control element, said first means having a longitudinal triangularly shaped channel defined by the roller means and a projection thereof, said triangular channel having an outwardly directed longitudinal opening along its base and a longitudinally extending vertex opposite said opening, said vertex forming a recess parallel to said longitudinal axis for receiving the line of attachment between the first sheet and a first one of said vanes, and a wedged shaped clamping member sized to be inserted into said triangular channel with said projection engaging behind said clamping member, wherein said wedge shaped clamping member cooperates with said first vane and said first sheet to force said line of attachment into the vertex of said triangular channel to ensure parallel alignment of said vanes with said roller means, and said second means attaching the second sheet to the roller means and pulling said first vane tightly around the roller means;

a first elongated member attached along the bottom edge of said first sheet; and a weight carried by said first elongated member, the position of said weight being adjustable transversely with respect to said light control element to compensate for and correct skewing of the covering device when retracted;

a second elongated member attached along the bottom of the second sheet parallel to the vanes; and a catch member pivotally connected to said roller means and movable between a first position pivoted inward and accommodated at least partially inside said light control element, and a second position pivoted outward and engaging an associated stop member fixed relative to said roller means, whereby as the light control element is unwound from the roller means said catch member is uncovered and pivots outward from said roller means to engage said stop member and thereby stop rotation of said roller means past a desired point, and whereby as the light control element is wound onto said roller means said catch member pivots in against said roller means and is accommodated at least partially inside the light control element when wound further onto said roller means.

39. A retractable covering device, comprising:

a housing having an elongated front rail and two end rails extending perpendicularly from lateral ends of said front rail;

roller means rotatably mounted between said two end rails and extending substantially parallel to said front rail, said roller means having a discontinuous surface formed by a plurality of projections, said projections defining recesses therebetween, said roller means including means for attaching a light control element thereto;

a light control element having first and second parallel sheets and a plurality of adjustable transverse vanes carried by and extending between said first and second sheets, said light control element being attached to said roller means along upper edge portions of said first and second sheets by said light control element attaching means;

a bottom rail attached along a bottom edge portion of at least one of said first and second sheets, said bottom rail having a weight slidably mounted therein; and a top-catch member carried by said housing and biased toward said roller means, whereby said top-catch member contacts said bottom rail to prevent rotation of said roller means in one direction when said light control element is completely wound around said roller means, and whereby said top-catch member contacts one of said projections of said roller means to prevent rotation of said roller means in the opposite direction when said light control element is completely unwound from said roller means.

40. The retractable covering device according to claim 39, further comprising means for mounting said housing on a support.

41. A retractable covering device comprising:

a light control element having first and second parallel sheets and a plurality of adjustable transverse vanes attached to said sheets along attachment lines, said vanes being carried between and connecting said sheets; and a roller rotatable about a longitudinal axis for rolling and unrolling said light control element, said roller including a plurality of means for defining apexes on an outer surface thereof, said apex defining means providing longitudinal contact points for said light control element around said roller and said apex defining means being spaced apart so as to provide a substantially straight path for said light control element from one apex defining means to an adjacent apex defining means, and said roller further including means for attaching said light control element, said attaching means including:

a recess formed in said roller for receiving the line of attachment between one of said sheets and a vane, said recess being parallel to the roller axis; and means for holding said line of attachment in said recess, said holding means comprising:

a longitudinal channel having a triangular cross-section provided on the outer surface of said roller, said triangular channel having an outwardly directed longitudinal opening along its base and a longitudinally extending vertex opposite said opening with said recess lying in said vertex; and an elongated wedge-shaped member which cooperates with said vane and said sheet to force said line of attachment between said vane and said sheet into the vertex of said triangular channel to ensure parallel alignment of said vane with said roller.

42. The covering device according to claim 41, wherein the line of attachment held in said recess by said holding means is the line of attachment between said first sheet and one vane, and said covering device further comprises an elongated member attached along the bottom edge of said second sheet, said elongated member having a recess formed therein for receiving the line of attachment between the second sheet and a second vane, said recess being parallel t the longitudinal direction of said elongated member, said elongated member further having a channel and a cooperating retainer member, said channel having a triangular cross section defined by said elongated member with an outwardly directed longitudinal opening along its base and a longitudinally extending vertex opposite said opening, with said recess lying in said vertex, and said retaining member being a elongated wedge-shaped member which cooperates with said second vane and said second sheet to force said line of attachment between said second vane and said second sheet into the vertex of said triangular channel.

43. A retractable covering device comprising:

a light control element having first and second parallel sheets and plurality of adjustable transverse vanes attached to said sheets along attachment lines, said vanes being carried between and connecting said sheets; and a roller rotatable about a longitudinal axis for rolling and unrolling said light control element, said roller including a plurality of means for defining apexes on an outer surface thereof, said apex defining means providing longitudinal contact points for said light control element around said roller and said apex defining means being spaced apart so as to provide a substantially straight path for said light control element from one apex defining means to an adjacent apex defining means, said apex defining means including at least one projection extending longitudinally along and radially outwardly from said roller, and said roller further including means for attaching said light control element, said attaching means comprising:

means for attaching said first sheet to said roller, including:

a recess formed in said roller for receiving the line of attachment between the first sheet and a vane, said recess being parallel to the roller axis, and means for holding said line of attachment in said recess, said holding means comprising a longitudinal channel having a triangular cross-section in the outer surface of the roller, said triangular channel having an outwardly directed longitudinal opening along its base and a longitudinally extending vertex opposite said opening with said recess lying in said vertex, and an elongated wedge-shaped member which cooperates with said vane and said first sheet to force said line of attachment between said vane and said first sheet into the vertex of said triangular channel to ensure parallel alignment of said vanes with said roller; and means for attaching said second sheet to said roller, including:

a longitudinal channel having a circular cross-section with a longitudinal opening having a width of less than the diameter of the channel, and a resilient tubular member which is compressible for placement through said opening, whereby the second sheet is wrapped at least partially around the tubular member and engaged in the channel by the tubular member;

an elongated member attached along bottom edge portions of both said first and second sheets, said elongated member having a channel of substantially C-shaped cross section defined therein with opposed longitudinal inward projections and having a resilient elongated strip, each longitudinal edge of said elongated strip engaging behind one of said longitudinal inward projections and said elongated strip exerting pressure thereon for securing said light control element in said elongated member when said elongated strip is inserted in said elongated member, whereby the bottom edges of the first and second sheets are wrapped around respective longitudinal edges of said elongated strip and said elongated strip is inserted in said C-shaped channel to attach said elongated member to said light control element; and a catch device for preventing said light control element from rolling up the wrong way, said catch device comprising:

a connecting member spaced away from said roller and fixed with respect to said roller; and a catch member pivotally mounted on said connecting member and biased toward said roller such that as the light control element is unrolled from the roller, the catch member contacts an outer surface of the unrolled up portion of the light control element and when the light control element is completely unrolled, the catch member engages the projection extending from the roller to prevent rotation of said roller past a predetermined point.

44. A retractable covering device comprising:

a light control element having first and second parallel sheets and a plurality of adjustable transverse vanes attached to said sheets along attachment lines, said vanes being carried between and connecting said sheets; and a roller rotatable about a longitudinal axis for rolling and unrolling said light control element, said roller including a plurality of means for defining apexes on an outer surface thereof, said apex defining means providing longitudinal contact points for said light control element around said roller and said apex defining means being spaced apart so as to provide a substantially straight path for said light control element from one apex defining means to an adjacent apex defining means, said apex defining means including at least two projections extending longitudinally along and radially outwardly from said roller, and said roller further including means for attaching said light control element, said attaching means including:

said two projections of said roller, each of said two projections terminating in a retaining edge, and an elongated strip extending between the retaining edges of said two projections and retained thereby, the upper edge portions of said first and second sheets extending around respective longitudinal edges of said elongated strip and being secured between said two projections and said elongated strip by pressure exerted by said elongated strip against said two projections to securely attach said light control element to said roller.

45. The covering device according to claim 44, wherein said elongated strip is retained by the retaining edges of said two projections such that said elongated strip is curved.

46. A covering device comprising:

a light control element having first and second parallel, vertical sheets with bottom edges and a plurality of adjustable transverse vanes attached to said sheets along attachment lines, said vanes being carried between and connecting said sheets; and means for finishing said bottom edges comprising a first elongated member having a channel and a cooperating retainer member, said first elongated member being attached along the bottom edges of both of said first and second sheets by means of said channel and retainer member, said channel having a substantially C-shaped cross-section defined by said first elongated member with opposed longitudinal inward projections, and said retainer member being a resilient elongated strip, each longitudinal edge of said elongated strip engaging behind one of said longitudinal inward projections and said elongated strip exerting pressure thereon for securing said light control element in said elongated member when said elongated strip is inserted in said elongated member, whereby the bottom edges of the first and second sheets are wrapped around respective longitudinal edges of said elongated strip and said elongated strip is inserted in said C-shaped channel to attach said first elongated member to said light control element, said elongated strip being curved when said elongated strip is engaged behind said longitudinal inward projections.

47. The covering device according to claim 46, wherein said first elongated member carries a weight, the position of said weight being adjustable transversely with respect to said light control element, whereby the transverse position of the weight may be adjusted to prevent skewing of said light control element while said light control element is being rolled up.

48. The covering device according to claim 41, wherein said first elongated member has a channel provided therein, said channel having a shape complementary to said weight and weight slides in said complementarily shaped channel in said first elongated member.

49. A method for mounting and deploying a retractable covering device including a light control element having first and second parallel sheets and a plurality of adjustable transverse vanes attached to said sheets along attachment lines, said vanes being carried between and connecting said sheets, said method comprising:

attaching said light control element to a roller by placing a wedge shaped strip inside a first one of said vanes and said first sheet with the vertex of the wedge shape lying along the line of attachment between said first vane and said first sheet, and inserting said wedge shaped strip, inside a first vane and first strip, into a triangular complementarily shaped channel in said roller, thereby holding said line of attachment in the vertex of said triangular channel, said vertex defining a recess for receiving said line of attachment parallel to said axis; and rolling and unrolling said light control element on said roller without forming creases or wrinkles in said sheets or vanes, said roller being rotatable about a longitudinal axis.

50. The method according to claim 49, further comprising tensioning said first vane around said roller, thereby pulling said line of attachment against said wedge shaped strip.

51. The method according to claim 50, wherein said tensioning step includes:

wrapping the second sheet at least partially around a resilient member; and inserting said resilient member into a receiving channel formed in said roller, said resilient member being engaged in said channel and said insertion exerting a tensioning force on said first vane which is maintained by said engagement.

52. A method for mounting and deploying a retractable covering device including a light control element having first and second parallel sheets and a plurality of adjustable spaced apart transverse vanes attached to said sheets along attachment lines, said vanes carried between and connecting said sheets, said method comprising:

attaching said light control element to a roller;

rolling and unrolling said light control element on said roller without forming creases or wrinkles in said sheets or vanes, said roller being rotatable about a longitudinal axis; and selectively positioning a weight on said covering device in a direction parallel to said transverse vanes to eliminate skewing of the light control element in the rolling and unrolling step, said weight being slidingly received for selective positioning in an elongated member attached to the bottom of one of the parallel sheets in spaced relation to said weight.

53. A method for mounting and deploying a retractable covering device including a light control element having first and second parallel sheets and a plurality of adjustable transverse vanes attached to said sheets along attachment lines, said vanes carried between and connecting said sheets, said method comprising:

attaching said light control element to a roller; and rolling and unrolling said light control element on said roller without forming creases or wrinkles in said sheets or vanes, said roller being rotatable about a longitudinal axis;

wherein at least two radially outwardly extending projections are provided on said roller, each of said two projections terminating in a retaining edge, and wherein said attaching step includes:

wrapping parallel edges of said first and second sheets around respective longitudinal edges of a resilient elongated strip; and then inserting said elongated strip between the retaining edges of said two projections, said elongated strip extending between said two projections and being retained therebetween by the retaining edges, and said elongated strip exerting pressure against said two projections to hold said edges of said first and second sheets between said elongated strip and said two projections.

54. The method according to claim 53, wherein said elongated strip is curved prior to insertion between said two projections, and said elongated strip is maintained in a curved state after insertion by the retaining edges.

55. A method for mounting a retractable covering device including a light control window covering having first and second parallel sheets and a plurality of adjustable transverse vanes attached to said sheets along lines of attachment, said vanes being carried between and connecting said sheets, said method comprising:

providing a roller with a discontinuous surface defining a number of recesses around the surface and extending the length of the roller, whereby said sheets and vanes may be wound onto said roller without forming creases or wrinkles in said sheets or vanes by receiving buckles formed in said sheets and vanes in said recesses;

placing a wedge shaped strip inside a first one of said vanes and said first sheet with a vertex of the wedge shape lying along the line of attachment between said first vane and said first sheet;

holding said line of attachment parallel with the roller by inserting said wedge shaped strip, inside said first vane and first strip, into a triangular complimentarily shaped channel formed in said roller parallel to the roller axis, thereby engaging said sheet and vane in said channel and locating said line of attachment in the vertex of said triangular channel; and tensioning said first vane around said roller, thereby pulling said line of attachment against said wedge shaped strip.

56. A method for mounting a retractable covering device including a light control element having first and second parallel sheets and a plurality of adjustable vanes attached to and connecting said sheets, said method comprising attaching said light control element to a roller means along a line of attachment between one of said vanes and one of said sheets by holding said line of attachment parallel to said roller means.

* * * * *

UNITED STATES PATENT AND TRADEMARK OFFICE

CERTIFICATE OF CORRECTION

PATENT NO. : 5,320,154

DATED : June 14, 1994

INVENTOR(S) : Wendell B. Colson, et. al.

It is certified that error appears in the above-indentified patent and that said Letters Patent is hereby corrected as shown below:

| | |
|---|---|
| Column 5, line 43 | "--16--" should read -- 16. -- |
| Column 5, line 51 | "--18--" should read -- 18. -- |
| Column 7, line 23 | "--24--" should read -- 24 (Fig. 5) -- |
| Column 7, line 36 | "--a--" should read -- an -- |
| Column 8, line 11 | "--40--" should read -- 40 (Fig. 3) -- |
| Column 9, line 7 | "--422--" should read -- 421 -- |
| Column 9, line 31 | "--424--" should read -- 426 -- |
| Column 12, line 13 | "--60--" should read -- 60 (Fig. 3) -- |
| Column 13, line 4 | "--350--" should read -- 350 (Figs. 10, 14a, 14b) -- |
| Column 13, line 43 | "--u--" should read -- up -- |

UNITED STATES PATENT AND TRADEMARK OFFICE

CERTIFICATE OF CORRECTION

PATENT NO. :5,320,154
DATED :June 14, 1994
INVENTOR(S) :Wendell B. Colson, et. al.

It is certified that error appears in the above-indentified patent and that said Letters Patent is hereby corrected as shown below:

| | |
|---|---|
| Column 18, line 53 | "--forceably--" should read -- forcibly -- |
| Column 19, line 64 | "--there--" should read -- therein -- |
| Column 23, line 31 | "--connected--" should read -- connecting -- |
| Column 25, line 52 | "--t--" should read -- to -- |
| Column 25, line 60 | "--a--" should read -- an -- |
| Column 28, line 14 | "--claim 41--" should read -- claim 47 -- |

Signed and Sealed this
Twelfth Day of September, 1995

*Attest:*

*Attesting Officer*

Bruce Lehman

BRUCE LEHMAN

*Commissioner of Patents and Trademarks*